US008808472B2

(12) United States Patent
Sandberg et al.

(10) Patent No.: US 8,808,472 B2
(45) Date of Patent: Aug. 19, 2014

(54) STEEL ALLOY, HOLDERS AND HOLDER DETAILS FOR PLASTIC MOULDING TOOLS, AND TOUGH HARDENED BLANKS FOR HOLDERS AND HOLDER DETAILS

(75) Inventors: Odd Sandberg, Uddeholm (SE); Magnus Tidesten, Hagfors (SE)

(73) Assignee: Uddeholms AB, Hagfors (SE)

( * ) Notice: Subject to any disclaimer, the term of this patent is extended or adjusted under 35 U.S.C. 154(b) by 1086 days.

(21) Appl. No.: 11/519,788

(22) Filed: Sep. 13, 2006

(65) Prior Publication Data

US 2007/0006949 A1 Jan. 11, 2007

Related U.S. Application Data

(63) Continuation-in-part of application No. 10/416,032, filed as application No. PCT/SE01/02576 on Nov. 22, 2001, now abandoned.

(30) Foreign Application Priority Data

Dec. 11, 2000 (SE) ..... 0004586

(51) Int. Cl.

| | |
|---|---|
| ***C22C 38/00*** | (2006.01) |
| ***C22C 38/60*** | (2006.01) |
| ***C22C 38/44*** | (2006.01) |
| ***C22C 38/46*** | (2006.01) |

(52) U.S. Cl.

USPC ..... 148/325; 420/42; 420/87

(58) Field of Classification Search

USPC ..... 148/400, 300, 306, 307, 310, 320, 325, 148/336, 337, 326, 328, 405; 420/8, 34, 42, 420/67, 69, 70, 84, 87, 119, 123, 124, 127, 420/128, 65, 120

See application file for complete search history.

(56) References Cited

U.S. PATENT DOCUMENTS

| | | | | |
|---|---|---|---|---|
| 3,362,813 | A | 1/1968 | Ziolkowski | 420/41 |
| 3,401,035 | A * | 9/1968 | Moskowitz et al. | 420/42 |

(Continued)

FOREIGN PATENT DOCUMENTS

| | | |
|---|---|---|
| DE | 42 12 966 C2 | 10/1993 |
| EP | 0 585 078 B1 | 3/1994 |

(Continued)

OTHER PUBLICATIONS

Higgins, Raymond A., Engineering Metallurgy, Part I: Applied Physical Metallurgy, 6th edition, Arnold Publishing, 1993. pp. 134-138. (7 pages total, including front matter).*

(Continued)

*Primary Examiner* — Scott Kastler
*Assistant Examiner* — Vanessa Luk
(74) *Attorney, Agent, or Firm* — Thomas, Karceski & Karmilovich, PC

(57) ABSTRACT

A steel alloy suitable for holders and holder details for plastic molding tools contains in weight-%: 0.06-0.15 C, 0.07-0.22 N, wherein the total amount of C+N shall satisfy the condition, 0.16≤C+N≤0.26, 0.1-1.0 Si, 0.1-2.0 Mn, 12.5-14.5 Cr, 0.8-2.5 Ni, 0.1 1.5 Mo, optionally vanadium up to max. 0.7 V, optionally, in order to improve the machinability of the steel, one or more of the elements S, Ca and O in amounts up to max. 0.25 S, max. 0.01 (100 ppm) Ca, max. 0.01 (100 ppm) O, balance iron and unavoidable impurities.

29 Claims, 21 Drawing Sheets

(56) References Cited

U.S. PATENT DOCUMENTS

| | | | | | |
|---|---|---|---|---|---|
| 4,564,392 | A | * | 1/1986 | Ohhashi et al. | 420/64 |
| 4,798,634 | A | * | 1/1989 | McCune et al. | 420/42 |
| 5,089,067 | A | * | 2/1992 | Schumacher | 148/325 |
| 5,503,979 | A | | 4/1996 | Kramer et al. | |
| 5,609,922 | A | * | 3/1997 | McDonald | 427/447 |
| 5,939,018 | A | * | 8/1999 | Ohtsubo et al. | 420/34 |
| 6,312,533 | B1 | * | 11/2001 | Yokota et al. | 148/325 |
| 6,679,954 | B1 | | 1/2004 | Takano et al. | |

FOREIGN PATENT DOCUMENTS

| | | | | | |
|---|---|---|---|---|---|
| EP | 1 006 204 | A1 | | 6/2000 | |
| JP | 55-54551 | | | 4/1980 | |
| JP | 11-335782 | | * | 12/1999 | C22C 38/00 |
| WO | 92/00158 | A1 | | 1/1992 | |
| WO | 00/49190 | A1 | | 8/2000 | |

OTHER PUBLICATIONS

Dewes, R.C. and D.K. Aspinwall, A review of ultra high speed milling of hardened steels, Journal of Materials Processing Technology, 69, pp. 1-17 (1997).*

Kotecki, D.J., "Welding of Stainless Steels," vol. 6, ASM Handbooks, 1993. pp. 677-683. (9 scanned pages total, including front matter).*

"Hardness Conversions for Steels," vol. 8: Mechanical Testing and Evaluation, ASM Handbooks Online, ASM International, 2003.*

Busch et al., "Medium-energy ion scattering study of arsenic and sulfur segregation to the Fe-9% W (100) surface," Surface Science, 463 (2000), pp. 145-155.*

"AISI Types 416, 416Se," Engineering Properties of Steel, ASM International, 1982, pp. 337-343.*

Office Action—Notice to File Response, Korean Patent Application No. 10-2003-7007737, with English Translation dated Aug. 23, 2007, (12 pgs).

Japanese Laid-open Patent Publication No. Hei 06-299301, dated Oct. 25, 1994; "110KSI Grade High Strength Corrosion Resistant Martensitic Stainless Steel Pipe"; 2 pgs (Abstract).

Patent Abstracts of Japan; "110KSI Grade High Strength Corrosion Resistant Martensitic Stainless Steel Pipe"; Publication No. 06-299301, dated Oct. 25, 1994, pp. 1-6 (Abstract).

Chiang, et al., "Influence of Silver Additions to Type 316 Stainless Steels on Bacterial Inhibition, Mechanical Properties, and Corrosion Resistance," Materials Chemistry and Physics, pp. 123-130 (Aug. 21, 2009).

Hong et al,, "Antibacterial Properties, Corrosion Resistance and Mechanical Properties of Cu-modified SUS 304 Stainless Steel," Materials Science and Engineering, A 393, pp. 213-222 (Jul. 31, 2004).

Definition of "Stainless Steel" provided by the American Iron and Steel Institute at http://www.steel.org/AM/Template.cfm?Section=Steel_Glossary2&CONTENTID=6426&TEMPLATE=/CM/HTMLDisplay.cfm, Oct. 18, 2010.

* cited by examiner

STEEL ALLOY, HOLDERS AND HOLDER DETAILS FOR PLASTIC MOULDING TOOLS, AND TOUGH HARDENED BLANKS FOR HOLDERS AND HOLDER DETAILS

CROSS-REFERENCE TO RELATED APPLICATIONS

This application is a Continuation-in-Part of application Ser. No. 10/416,032, filed May 7, 2003, which is a Continuation-in-Part of PCT International Application No. PCT/SE01/02576, filed 22 Nov. 2001, which claims priority to Swedish Application No. 0004586-4, filed 11 Dec. 2000. The entire content of these applications are incorporated herein by reference.

TECHNICAL FIELD

The invention relates to a steel alloy and particularly to a steel alloy for the manufacturing of holders and holder details for plastic moulding tools. The invention also concerns holders and holder details manufactured of the steel, as well as blanks made of the steel alloy for the manufacturing of such holders and holder details.

BACKGROUND OF THE INVENTION

Holders and holder details for plastic moulding tools are employed as clamping and/or framing components for the plastic moulding tool in tool sets, in which tool the plastic product shall be manufactured through some kind of moulding method. Among conceivable holder details there can be mentioned bolster plates and other construction parts as well as heavy blocks with large recesses which can accommodate and hold the actual moulding tool. Said holders and holder details are made of many different steel alloys, including martensitic stainless steels. A steel which is manufactured and marketed by the applicant under the registered trade name RAMAX S® belongs to that group and has the following nominal composition in weight-%: 0.33 C, 0.35 Si, 1.35 Mn, 16.6 Cr, 0.55 Ni, 0.12 N, 0.12 S, balance iron and impurities from the manufacturing of the steel. The closest comparable standardized steel is AISI 420F. Steels of this type have an adequate corrosion resistance, but do not have a martensitic micro-structure which is as homogenous that is desirable, but may contain ferrite and hard spots, which are due to retained, untempered martensite, which in turn can be explained by a certain segregation tendency of the steel. Therefore it exists a demand of improvements as far as holder steels are concerned. It is also desirable that the same steel, possibly with some modification of the composition, also shall be useful for the actual moulding tool.

DISCLOSURE OF THE INVENTION

It is an object of the invention to provide a steel, which after hardening and tempering has a more even structure than the above mentioned steel, essentially without ferrite and/or spots in the material which have a pronouncedly higher hardness.

The invention also aims to achieve one or several of the following effects:

A good machinability.

An adequate corrosion resistance.

An adequate hardenability, considering the steel shall be possible to be used for the manufacturing of holder blocks made of plates which may have a thickness of up to at least 300 mm and in some cases even up to 400 mm thickness.

An adequate ductility/toughness.

A hardness of 30-42 HRC, preferably 38-40 HRC in the tough-hardened condition.

A good polishability, at least according to a preferred embodiment, in order to able to be used also for moulding tools on which high demands are raised as far as polishability is concerned.

The above objectives can be achieved if the steel has the chemical composition which is stated in the appending patent claims.

As far as the importance of the separate elements and their interaction in the steel are concerned, the following may be considered to apply without binding the claimed patent protection to any specific theory.

Carbon and nitrogen are elements which have a great importance for the hardness and ductility of the steel. Carbon is also an important hardenability promoting element. Carbon, however, binds chromium in the form of chromium carbides (M7C3-carbides) and may therefore impair the corrosion resistance of the steel. The steel therefore may contain max 0.15% carbon, preferably max 0.13% carbon (in this text always weight-% is referred to if not otherwise is stated). However, carbon also has some advantageous effects, such as to exist together with nitrogen as a dissolved element in the tempered martensite in order to contribute to the hardness thereof, and also acts as an austenite stabilizer and thence counteract ferrite in the structure. The minimum amount of carbon in the steel therefore shall be 0.06%, preferably at least 0.07%.

Nitrogen contributes to the provision of a more even, more homogenous distribution of carbides and carbonitrides by affecting the solidification conditions in the alloy system such that larger aggregates of carbides are avoided or are reduced during the solidify-cation. The proportion of M23C6-carbides also is reduced in favour of M(C,N), i.e. vanadium-carbonitrides, which has a favourable impact on the ductility/toughness. In summary, nitrogen contributes to the provision of a more favourable solidification process implying smaller carbides and nitrides, which can be broken up during the working to a more finely dispersed phase. From these reasons nitrogen shall exist in an amount of at least 0.07%, preferably at least 0.08%, but not more than 0.22%, preferably max 0.15%, at the same time as the total amount of carbon and nitrogen shall satisfy the condition $0.16 \leq C+N \leq 0.26$. Preferably, C+N shall be at least 0.17% but suitably max 0.23%. Nominally, the steel contains 0.20-0.22 (C+N). In the hardened and tempered steel, nitrogen is substantially dissolved in the martensite in the form of nitrogen-martensite in solid solution and thence contributes to the desired hardness.

In summary, as far as the content of nitrogen is concerned, it can be stated that nitrogen shall exist in the said minimum amount in order to contribute to the desired corrosion resistance by increasing the so called PRE-value of the matrix of the steel, to exist as a dissolved element in the tempered martensite which contributes to the hardness of the martensite, and to form carbonitrides, M(C, N), to a desired degree together with carbon, but not exceed said maximum content, maximizing the content of carbon+nitrogen, where carbon is the most important hardness contributor.

Silicon increases the carbon activity of the steel and thence the tendency to precipitate more primary carbides. This is a first reason why it is desirable that the steel has a low content of silicon. Further, silicon is a ferrite stabilizing element, which is a disadventageous feature of silicon. As the steel also shall contain the ferrite stabilizing elements chromium and molybdenum in sufficient amounts to provide desirable effects by those elements, at the same time as the steel contains a lower content of carbon than is conventional in steels for the application in question, the content of silicon should be restricted in order not to cause the steel to contain ferrite in its matrix. The steel therefore must not contain more that 1% Si, preferably max. 0.7% Si, suitably max. 0.5% Si, and most conveniently a still lower content of silicon. Generally the rule shall apply that the ferrite stabilizing elements shall be adapted to the austenite stabilizing ones in order to avoid formation of ferrite in the steel. However, silicon exists as a residue from the desoxidation treatment, wherefore the optimum content of silicon lies in the range 0.05-0.5%, normally in the range 0.1-0.4%, and is nominally about 0.2-0.3%.

Manganese is an element which promotes austenite and hardenability, which is a favourable effect of manganese, and can also be employed for sulphur refining by forming harmless manganese sulphides in the steel. Manganese therefore shall exist in a minimum amount of 0.1%, preferably at least 0.3%. Manganese, however has a segregation tendency together with phosphorous which can give rise to tempering embrittlement. Manganese therefore must not exist in an amount exceeding 2%, preferably max. 1.5%, suitably max. 1.3%.

Chromium is the main alloying element of the steel and is essentially responsible for provision of the stainless character of the steel, which is an important feature of holders and holder details for plastic moulding tools, as well as for the plastic moulding tool itself, which often is used in damp environments, which may cause less corrosion resistant steels to rust.

Chromium also is the most important hardenability promoting element of the steel. However, no substantial amounts of chromium are bound in the form of carbides, because the steel has a comparatively low carbon content, wherefore the steel can have a chromium content as low as 12.5% and nevertheless get a desired corrosion resistance. Preferably the steel, however, contains at least 13.0% chromium. The upper limit is determined in the first place by the ferrite forming tendency of chromium. The steel therefore must not contain more than max. 14.5% Cr, preferably max. 14.0% Cr. Nominally, the steel should contain 13.1-13.7% Cr.

Nickel should exist in the steel in a minimum amount of 0.8%, preferably at least 1.0%, in order to afford the steel a very high hardenability. From cost reasons, however, the content should be limited to max. 2.5%, preferably to max. 2.0%. Nominally, the steel contains 1.4-1.8% or about 1.6% Ni.

Optionally, the steel of the invention also may contain an active content of vanadium in order to bring about a secondary hardening through precipitation of secondary carbides in connection with the tempering operation, wherein the tempering resistance is increased. Vanadium, when present, also acts as a grain growth inhibitor through the precipitation of MC-carbides. If the content of vanadium is too high, however, there will be formed large primary MC-carbonitrides during the solidification of the steel, and this also occurs if the steel is subjected to ESR-remelting, which primary carbides will not be dissolved during the hardening procedure. For the achievement of the desired secondary hardening and for the provision of a favourable contribution to the grain growth inhibition, but at the same time avoiding formation of large, undissolvable primary carbides in the steel, the optional content of vanadium should lie in the range 0.07-0.7% V. A suitable content is 0.10-0.30% V, nominally about 0.2% V.

Preferably, the steel also contains an active content of molybdenum, e.g. at least 0.1%, in order to give a hardenability promoting effect. Molybdenum up to an amount of at least 1.0% also promotes the corrosion resistance but may have effect also if the content is higher. When tempering, molybdenum also contributes to increasing the tempering resistance of the steel, which is favourable. On the other hand, a too high content of molybdenum may give rise to an unfavourable carbide structure by causing a tendency to precipitation of grain boundary carbides and segregations. Besides, molybdenum is ferrite stabilizing, which is unfavourable. The steel therefore shall contain a balanced content of molybdenum in order to take advantage of its favourable effects but at the same time avoid those ones which are unfavourable. Preferably, the content of molybdenum should not exceed 1.7%. An optimal content may lie in the range 0.1-0.9%, probably in the range 0.4-0.6% Mo.

Normally, the steel does not contain tungsten in amounts exceeding the impurity level, but may possibly be tolerated in amounts up to 1%.

The steel of the invention shall be possible to be delivered in its tough-hardened condition, which makes it possible to manufacture large sized holders and mould tools through machining operations. The hardening is carried out through austenitizing at a temperature of 850-1000° C., preferably at 900-975° C., or at about 950° C., followed by cooling in oil or in a polymer bath, by cooling in gas in a vacuum furnace, or in air. The high temperature tempering for the achievement of a tough hardened material with a hardness of 30-42 HRC, preferably 38-41 or about 40 HRC, which is suitable for machining operations, is performed at a temperature of 510-650° C., preferably at 520-540° C., for at least one hour, preferably through double tempering; twice for two hours. The steel may, as an alternative, be low temperature tempered at 200-275° C., e.g. at about 250° C., in order obtain a hardness of 38-42 or about 40 HRC.

The steel may, according to a preferred embodiment, also contain an active content of sulphur, possibly in combination with calcium and oxygen, in order to improve the machinability of the steel in its tough hardened condition. In order to obtain best effect in terms of machinability improvement, the steel should contain at least 0.07% S if the steel does not also contain an intentionally added amount of calcium and oxygen, and at least 0.035%, respectively, if the steel also contains an active amount of calcium and oxygen. The maximum sulphur content of the steel is 0.25%, when the steel is intentionally alloyed with a content of sulphur. A suitable sulphur content in this case may be 0.12%. Also a non-sulphurized variant of the steel, however, can be conceived. In this case the steel does not contain sulphur above impurity level, and nor does that steel contain any active contents of calcium and/or oxygen.

It is thus conceivable that the steel may contain 0.035-0.25% S in combination with 3-100 weight-ppm Ca, preferably 5-75 ppm Ca, suitably max. 40 ppm Ca, and 10-100 ppm 0, wherein said calcium, which may be supplied as silicon-calcium, CaSi, in order to globulize existing sulphides to form calcium sulphides, counteracts that the sulphides get a non-desired, elongated shape, which might impair the ductility.

The steel of the invention can be manufactured conventionally at a production scale by manufacturing a metal melt in the normal way, said melt having a chemical composition according to the invention, and casting the melt into large ingots or casting the melt continuously. It is also possible to cast electrodes of the molten metal and then remelting the electrodes through Electro-Slag-Remelting (ESR). It is also possible to manufacture ingots powder-metallurgically through gas-atomization of the melt to produce a powder, which then is compacted through a technique which may comprise hot isostatic pressing, so called HIPing, or, as an alternative, manufacture ingots through sprayforming.

Further characteristics, aspects and features of the steel according to the invention, and its usefulness for the manufacturing of holders and moulding tools, will be explained more in detail in the following through a description of performed experiments and achieved results.

BRIEF DESCRIPTION OF DRAWINGS

In the following description of performed experiments and achieved results, reference will be made to the accompanying drawings, in which FIG. 6A and FIG. 6B are bar charts which illustrate the critical current density, Icr, measured when corrosion testing samples which had been slowly cooled in a vacuum furnace at two different cooling rates from the austenitizing temperature and which thereafter had been high temperature tempered to about 40HRC, in the following description of performed experiments and achieved results according to the new variant of the steel, reference will be made to the accompanying drawings, in which:

EXAMINATION OF STEELS MANUFACTURED AT A LABORATORY SCALE

Figure 1:
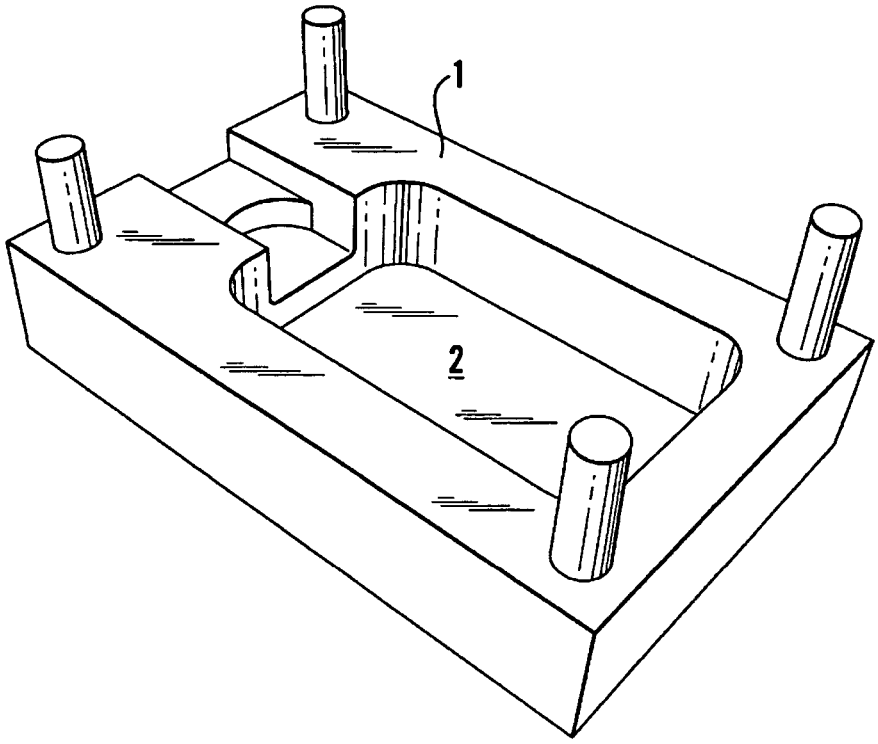
FIG. 1 shows a holder block of a typical design, which can be manufactured of the steel according to the invention.

FIG. 1 shows a holder block 1 of a typical design, which shall be possible to be manufactured of the steel according to the invention. In the blockl there is a cavity 2, which shall accommodate a mould tool, usually a plastic moulding tool. The block 1 has considerable dimensions and the cavity 2 is large and deep. Therefore, a number of different requirements are raised on the material according to the invention, i.a. an adequate hardenability with reference to the considerable thickness of the block, and a good ability to be machined by means of cutting tools, such as mill cutters and borers.

Material

17 Q-ingots (50 kg laboratory heats) with compositions according to Table I were manufactured in four rounds. In the first round (Q9043-Q9080), ingots were manufactured having chemical compositions within a wide range; e.g. variants having comparatively high contents of nitrogen were tested. It was revealed that the alloy having the most interesting features was Q9068, i.e. with carbon contents lying in medium range around 0.10% and with moderate contents of nitrogen.

In the second round (Q9129-Q9132) one tried to optimize the features that were obtained by Q9068. The carbon content was slightly varied, vanadium was added in order to obtain a finer grain size, and the nickel content was lowered for one of the variants.

In the third round (Q9129-Q9139) variants having increased sulphur contents were tested.

In a fourth round only two steels, Q9153 and Q9154, were tested in order to evaluate the relations between carbon and nitrogen.

The steels Q9043 and Q9063 are reference materials. Q9043 has a composition according to SIS2314 and AISI 420, while Q9063 corresponds to W.Nr. 1.2316.

The Q-ingots were forged to the shape of rods of size 60×40 mm, whereupon the rods were cooled in vermiculite.

TABLE I

Test materials; chemical composition in weight-%, balance Fe and unavoidable impurities

| Q-ingot | C | N | Si | Mn | Cr | V | Ni | Mo | S |
|---|---|---|---|---|---|---|---|---|---|
| Q9043 | 0.36 | 0.026 | 0.83 | 0.47 | 13.9 | 0.32 | 0.18 | 0.12 | n.a. |
| Q9063 | 0.37 | 0.12 | 0.17 | 0.55 | 15.7 | | 0.8 | 1.19 | n.a. |
| Q9064 | 0.27 | 0.18 | 0.14 | 1.35 | 16.7 | 0.3 | 1.61 | 0.44 | n.a. |
| Q9065 | 0.20 | 0.16 | 0.185 | 1.29 | 15.7 | 0.15 | 1.56 | 0.74 | n.a. |
| Q9067 | 0.11 | 0.063 | 0.18 | 1.1 | 12.3 | | 0.73 | 0.33 | n.a. |
| Q9068 | 0.11 | 0.059 | 0.17 | 1.06 | 13.4 | 0.067 | 2.1 | 0.75 | n.a. |
| Q9069 | 0.075 | 0.084 | 0.15 | 1.01 | 12.4 | 0.076 | 0.75 | 0.34 | n.a. |
| Q9070 | 0.076 | 0.085 | 0.18 | 1.14 | 13.8 | 0.06 | 0.74 | 0.32 | n.a. |
| Q9080 | 0.15 | 0.17 | 0.21 | 1.26 | 16 | 0.12 | 1.56 | 0.75 | n.a. |
| Q9129 | 0.097 | 0.087 | 0.16 | 1.06 | 12.8 | 0.2 | 1.6 | 0.22 | n.a. |

TABLE I-continued

| Test materials; chemical composition in weight-%, balance Fe and unavoidable impurities | | | | | | | | | |
|---|---|---|---|---|---|---|---|---|---|
| Q-ingot | C | N | Si | Mn | Cr | V | Ni | Mo | S |
| Q9131 | 0.11 | 0.088 | 0.15 | 1.07 | 12.7 | 0.19 | 0.86 | 0.22 | n.a. |
| Q9132 | 0.14 | 0.094 | 0.14 | 1.11 | 12.7 | 0.19 | 1.61 | 0.22 | n.a. |
| Q9135 | 0.19 | 0.039 | 0.12 | 0.93 | 13.4 | 0.27 | 1.02 | 0.21 | 0.07 |
| Q9136 | 0.07 | 0.091 | 0.15 | 1.17 | 14.9 | 0.22 | 1.04 | 0.21 | 0.075 |
| Q9139 | 0.12 | 0.092 | 0.17 | 1.23 | 14.2 | 0.20 | 1.06 | 0.22 | 0.14 |
| Q9153 | 0.12 | 0.10 | 0.14 | 0.81 | 12.7 | 0.20 | 1.58 | 0.24 | 0.0059 |
| Q9154 | 0.06 | 0.14 | 0.17 | 0.88 | 12.5 | 0.21 | 1.53 | 0.21 | 0.0053 |

n.a. = not analyzed

Hardness after Heat Treatment

Figure 2A:
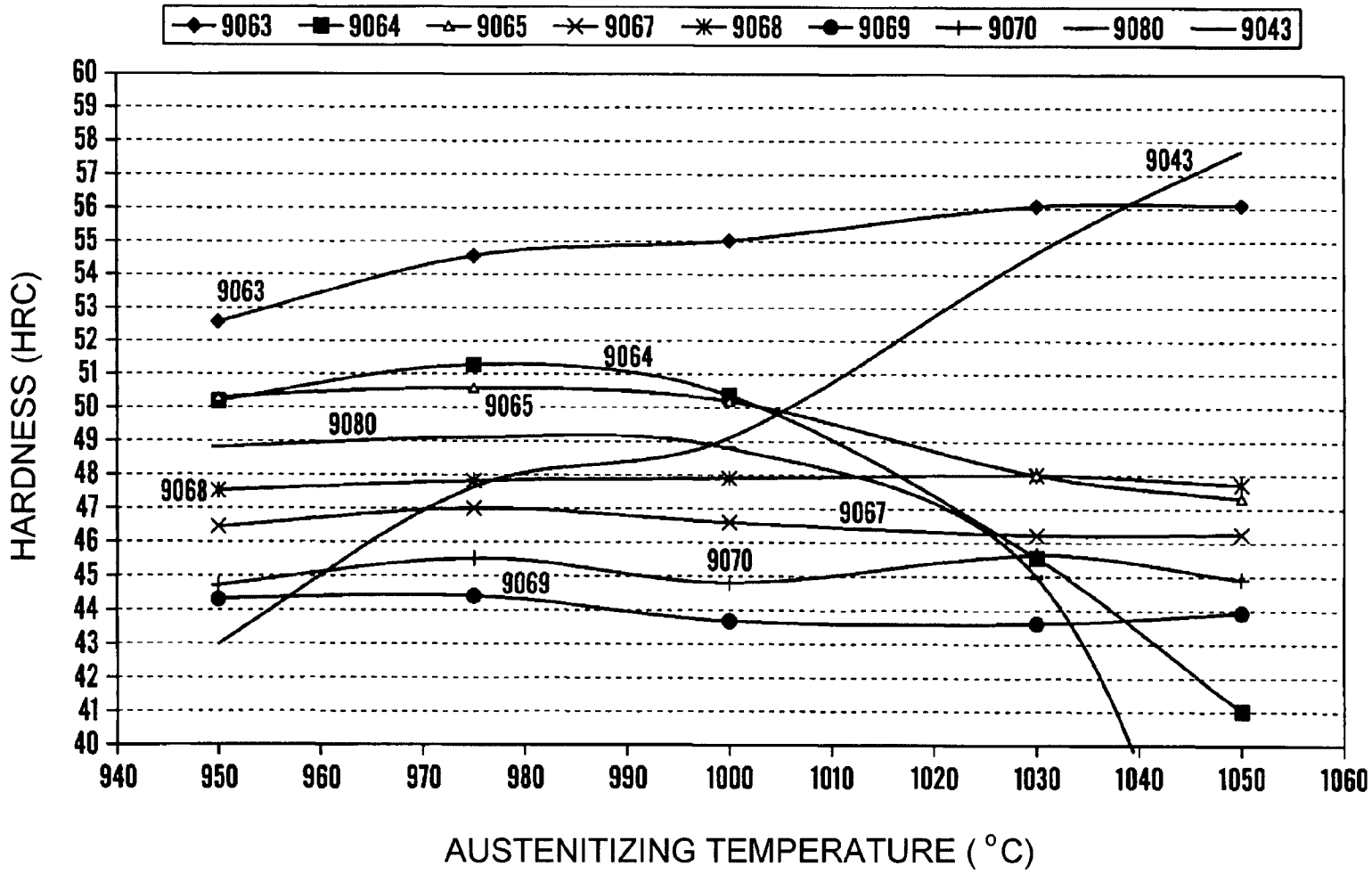
FIG. 2A is a chart showing the hardness of a first set of steels, produced in the form of so called Q-ingots (50 kg laboratory heats), after hardening but before tempering, versus the austenitizing temperature at a holding time of 30 min.
Figure 2B:
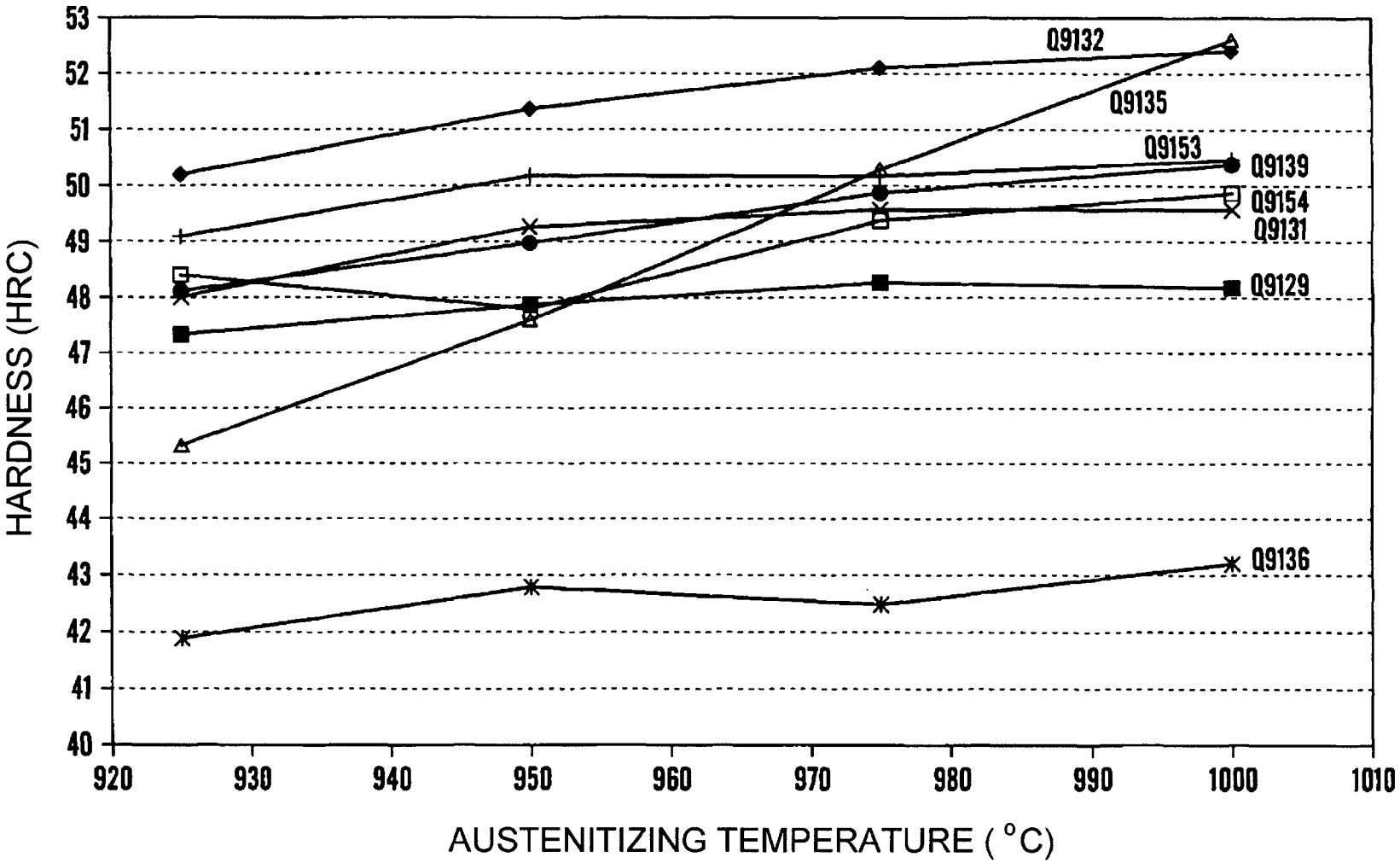
FIG. 2B shows corresponding graphs for another number of tested steels manufactured as Q-ingots.

The hardness versus the austenitizing temperature is shown in FIG. 2A and FIG. 2B. It is evident from the charts of these drawings that the hardness increases with increasing austenitizing temperature for some steels having a higher carbon content, such as for Q9043, Q9063, Q9103, Q9104 and Q9135. 1030° C. is an austenitizing temperature which may be appropriate in these cases. For other steels, the hardness decreases or remains constant with increasing austenitizing temperature. In that case it may be more appropriate to choose 950° C. as an austenitizing temperature.

Figure 3A:
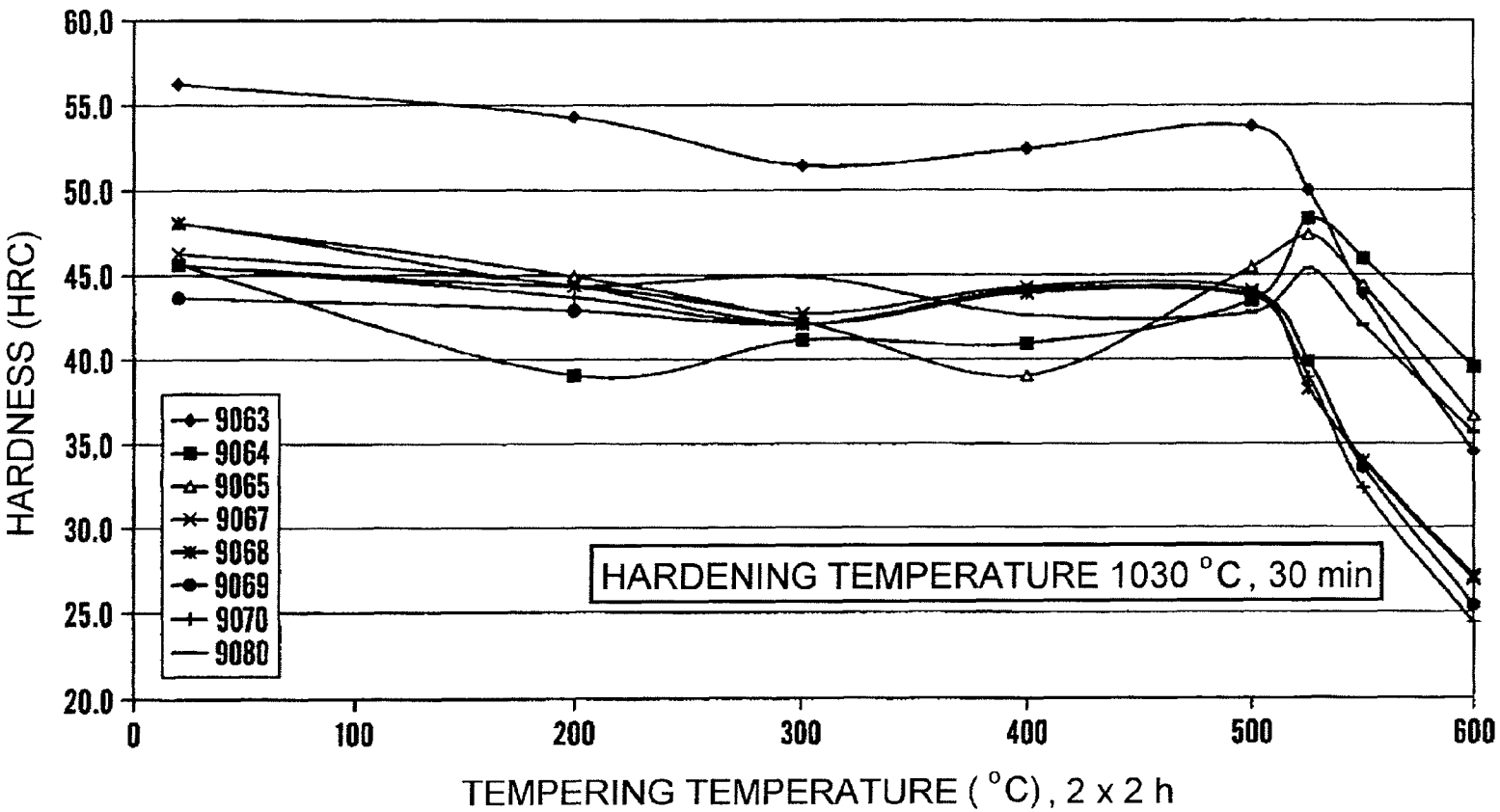
FIG. 3A shows tempering curves for those steels in the first set which have been hardened from 1030° C.
Figure 3B:
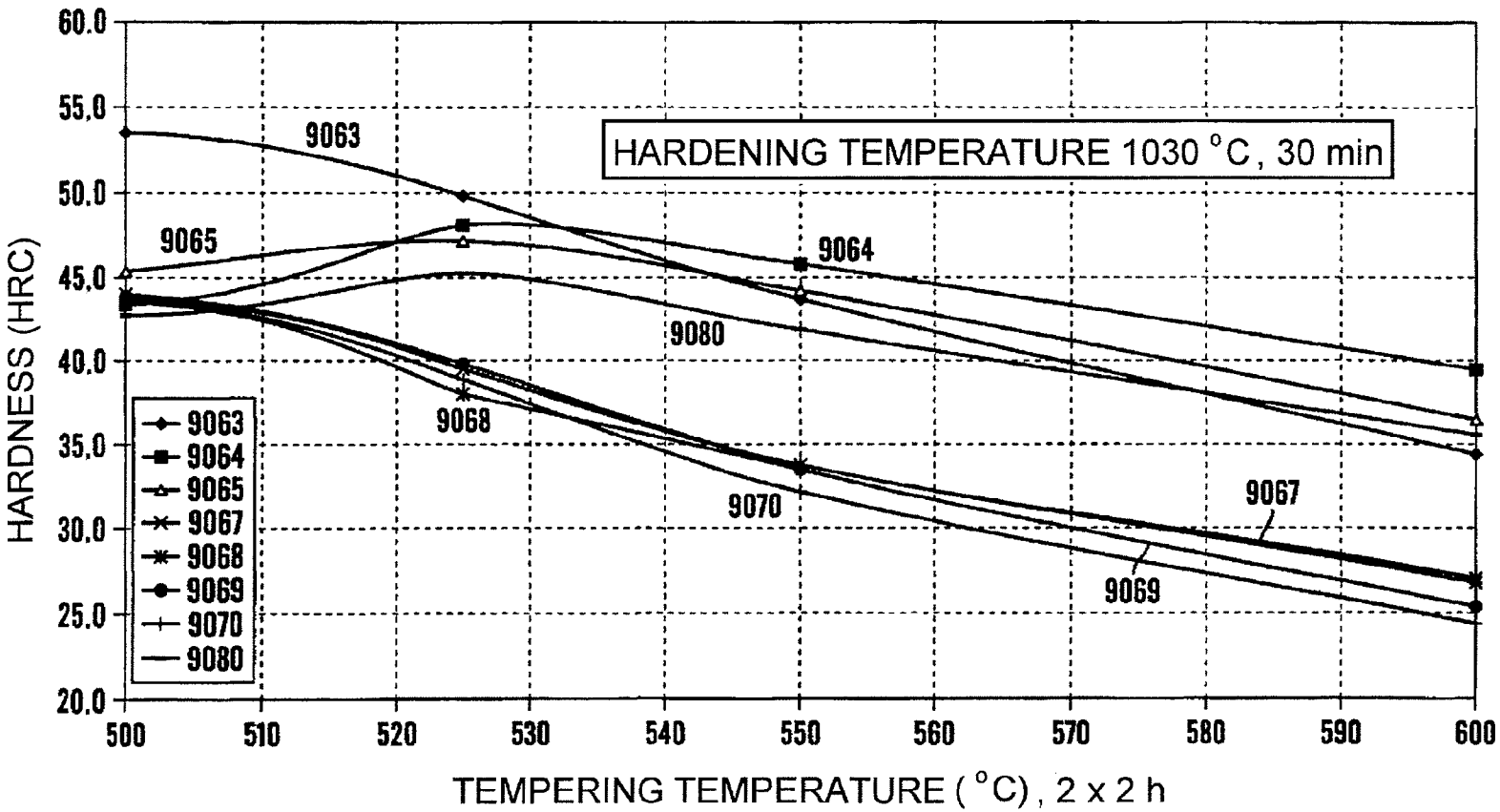
FIG. 3B shows the tempering temperature range 500-550° C. of the tempering curves of FIG. 3A at a larger scale.
Figure 3C:
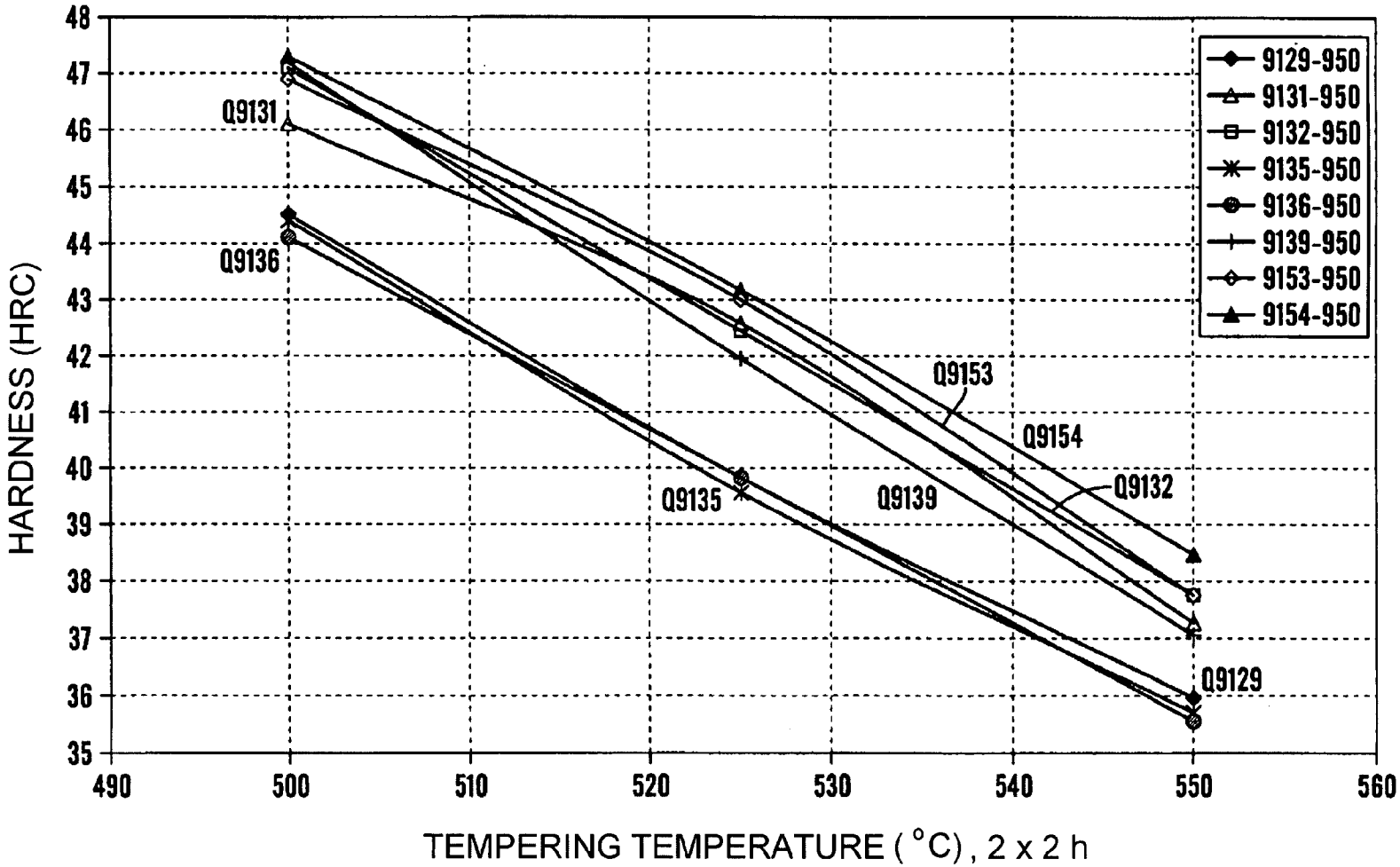
FIG. 3C shows tempering curves within the tempering temperature range 500-550° C. for those further tested steels, whose hardness versus the austenitizing temperature was shown in FIG. 2B.

The hardness after tempering of those steels which had been hardened from 1030° C. are shown in FIG. 3A and FIG. 3B, while all the tempering curves for those ones of the Q-ingots 9129-9154 which had been hardened from 950° C. are shown in the diagram in FIG. 3C. The conclusion can be drawn from the tempering curves that all the steels can be tempered down to 40 HRC through tempering in the temperature range 520-600° C.

An appropriate hardness of the steel after tough-hardening is about 40 HRC. In Table II below, the heat treatments are stated which provide the said hardness to the different steels.

TABLE II

| Heat treatment for tough-hardening, measured rest austenite, percent by volume | | |
|---|---|---|
| Q-ingot No | Heat treatment | Rest austenite (%) |
| 9063 | 1030° C./30 min + 550° C./2 × 2 h | 0 |
| 9064 | 1030° C./30 min + 550° C./2 × 2 h | 1.3 |
| 9065 | 1030° C./30 min + 550° C./2 × 2 h | 2.3 |
| 9067 | 1030° C./30 min + 525° C./2 × 2 h | 0 |
| 9068 | 1030° C./30 min + 525° C./2 × 2 h | 0 |
| 9069 | 1030° C./30 min + 525° C./2 × 2 h | 0 |
| 9070 | 1030° C./30 min + 525° C./2 × 2 h | 0 |
| 9080 | 1030° C./30 min + 550° C./2 × 2 h | 6.4 |
| 9104 | 1030° C./30 min + 550° C./2 × 2 h | 0 |
| 9129* | 950° C./30 min + 525° C./2 × 2 h | 0 |
| 9131* | 950° C./30 min + 525° C./2 × 2 h + 535/2 h | 0 |
| 9132* | 950° C./30 min + 525° C./2 × 2 h + 535/2 h | 0 |
| 9135* | 950° C./30 min + 525° C./2 × 2 h | 0 |
| 9136* | 950° C./30 min + 525° C./2 h + 500/2 h | 0 |
| 9139* | 950° C./30 min + 525° C./2 × 2 h | 0 |
| 9153** | 950° C./30 min + 535° C./2 × 2 h | 0 |
| 9154 | 950° C./30 min + 540° C./2 × 2 h | Not measured |

*t8/5 = 1964 s

**t8/5 = 1885 s (t8/5 corresponds to the time for cooling a sample from 800 to 500° C.)

Hardenability

Figure 4:
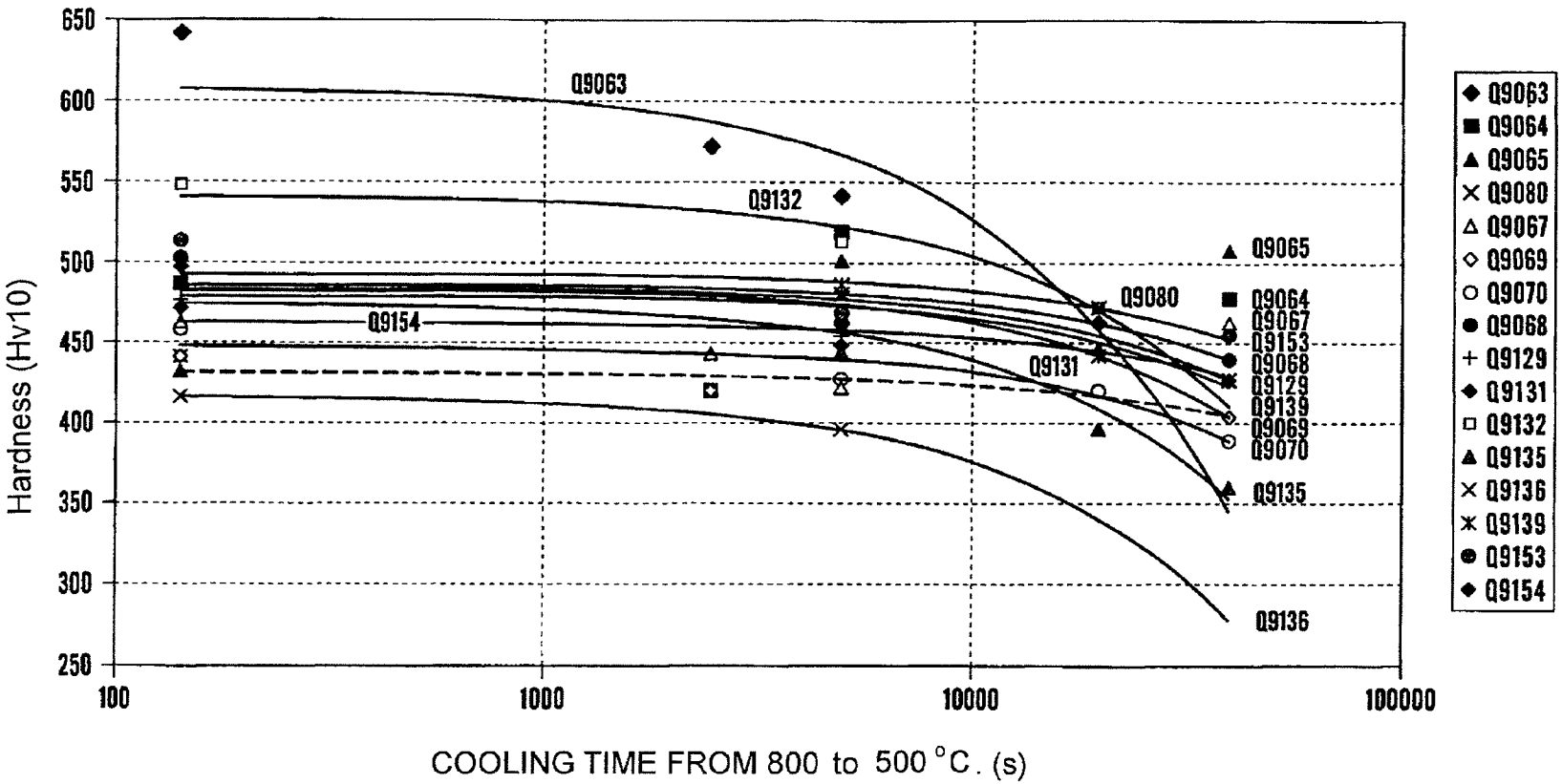
FIG. 4 is a chart which showing hardenability curves for the steels which were tested as stated above.

The hardness after hardening from the austenitizing temperatures which are given in Table II, from which temperatures the samples have been cooled at different rates, is shown in the hardenability curves of FIG. 4.

Impact Toughness Tests

Figure 5:
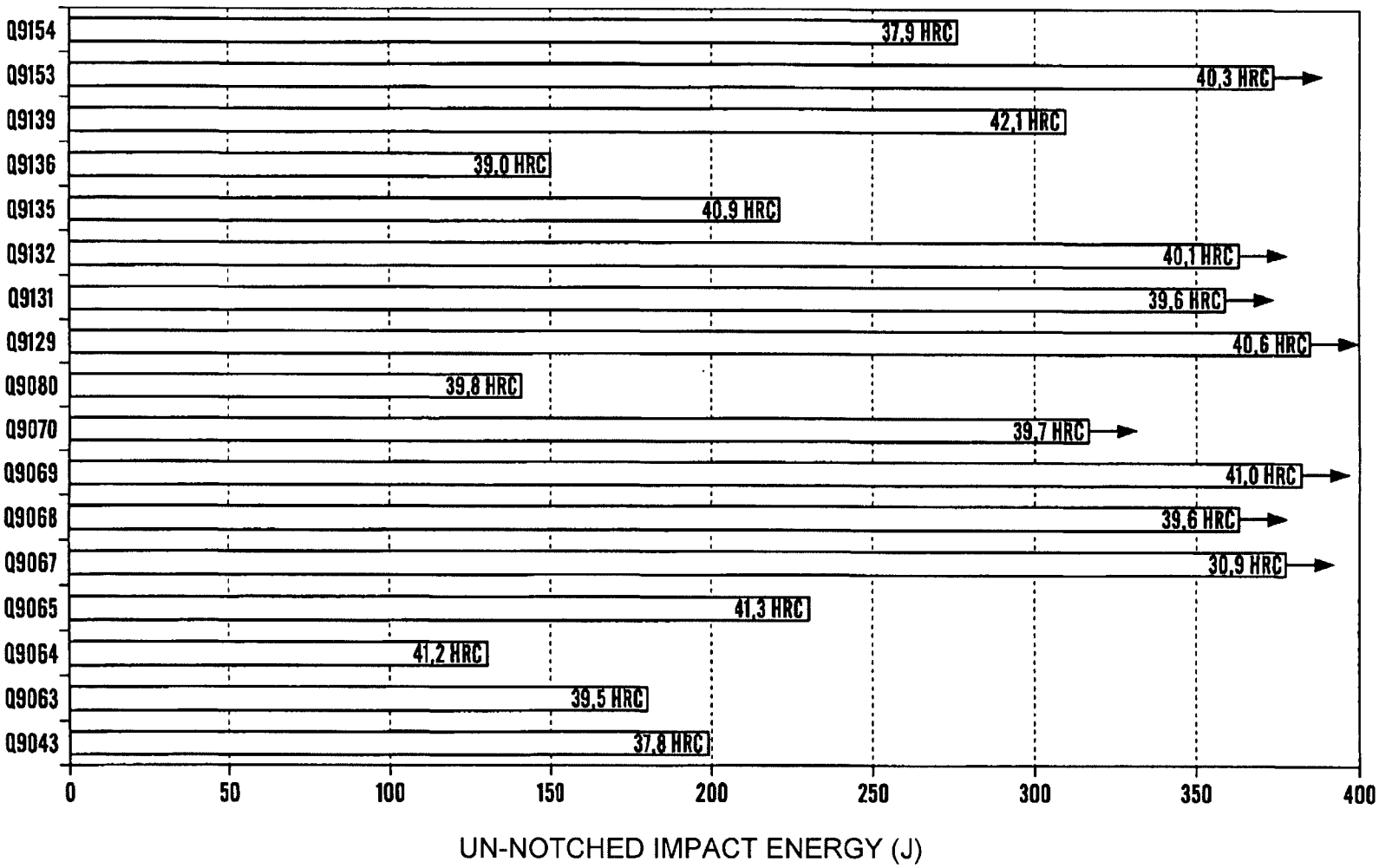
FIG. 5 is a bar chart illustrating results from impact toughness testing of the above mentioned steels.

Impact toughness testing of un-notched test specimens, mean values for four to six test rods of each steel, was performed at room temperature. The heat treatments and cooling rates, which were employed for the different steels, are given in Table III. The results are disclosed by the bar chart in FIG. 5. From this chart it can be recognized that some variants, such as Q9067, 9068, 9069, 9129, 9131, 9132 and Q9153 have a very high ductility, >350 J, and that the test rods were not ruptured, but also that some other steels, including e.g. steel Q9154, have a considerably better ductility than the reference steels, Q9063 and 9043, which lie on the 180-200 J level.

TABLE III

| Q-ingot No | Heat treatment ° C. | Cooling rate t8/5 (s) |
|---|---|---|
| 9043 | 1030/30 + 560/2 h + 550/2 h | 2093 |
| 9063 | 1030/30 + 570/2 h + 560/2 h | 2093 |
| 9064 | 950/30 + 560/2 × 2 h | 2093 |
| 9065 | 950/30 + 550/2 × 2 h | 2093 |
| 9067 | 950/30 + 525/2 × 2 h | 2093 |
| 9068 | 950/30 + 525/2 × 2 h | 2093 |
| 9069 | 950/30 + 525/2 × 2 h | 2093 |
| 9070 | 950/30 + 525/2 × 2 h | 2093 |
| 9080 | 950/30 + 550/2 × 2 h | 2093 |
| 9129 | 950/30 + 525/2 × 2 h | 1969 |
| 9131 | 950/30 + 525/2 × 2 h + 535/2 h | 1969 |
| 9132 | 950/30 + 525/2 × 2 h + 535/2 h | 1969 |
| 9135 | 950/30 + 525/2 × 2 h | 1964 |
| 9136 | 950/30 + 525/2 × 2 h + 500/2 h | 1964 |
| 9139 | 950/30 + 525/2 × 2 h | 1964 |
| 9153 | 950/30 + 535/2 × 2 h | 1985 |
| 9154 | 950/30 + 540/2 × 2 h | 1863 |

Corrosion Tests

Polarization curves were established in a first test round for the steels given in Table IV in terms of critical current density, Icr, for the evaluation of the corrosion resistance of the steels. As far as this method of measurement is concerned, the rule is that the lower Ire is, the better is the corrosion resistance. The investigations were performed in two test series, in which the test specimens were subjected to different cooling rates. The heat treatments of the first series are shown in Table IV.

TABLE IV

| Heat treatment of polarization test specimens. Cooling in vacuum furnace | | | |
|---|---|---|---|
| Q-ingot No | Heat treatment | T8/5 (s) | Hardness (HRC) |
| 9063 | 1030° C./30 min + 570° C./2 × 2 h | 860 | 40.8 |
| 9064 | 1030° C./30 min + 600° C./2 × 2 h | 860 | 40.5 |
| 9065 | 1030° C./30 min + 580° C./2 × 2 h | 860 | 40.0 |
| 9067 | 1030° C./30 min + 525° C./2 × 2 h + 535° C./1 h | 860 | 38 |
| 9068 | 1030° C./30 min + 525° C./2 × 2 h | 860 | 40.1 |
| 9069 | 1030° C./30 min + 525° C./2 × 2 h + 535° C./1 h | 860 | 40 |
| 9070 | 1030° C./30 min + 525° C./2 × 2 h + 535° C./1 h | 860 | 39 |
| 9080 | 1030° C./30 min + 565° C./2 h + 550° C./2 h | 860 | 40.6 |
| 9129 | 950° C./30 min + 525° C./2 h + 535°/2 h | 876 | 39.7 |
| 9131 | 950° C./30 min + 525° C./2 h + 535° C./2 h | 876 | 40.2 |
| 9132 | 950° C./30 min + 535° C./2 × 2 h | 876 | 39.7 |
| 9153 | 950° C./30 min + 535° C./2 × 2 h | 957 | 39.4 |

Figure 6A:
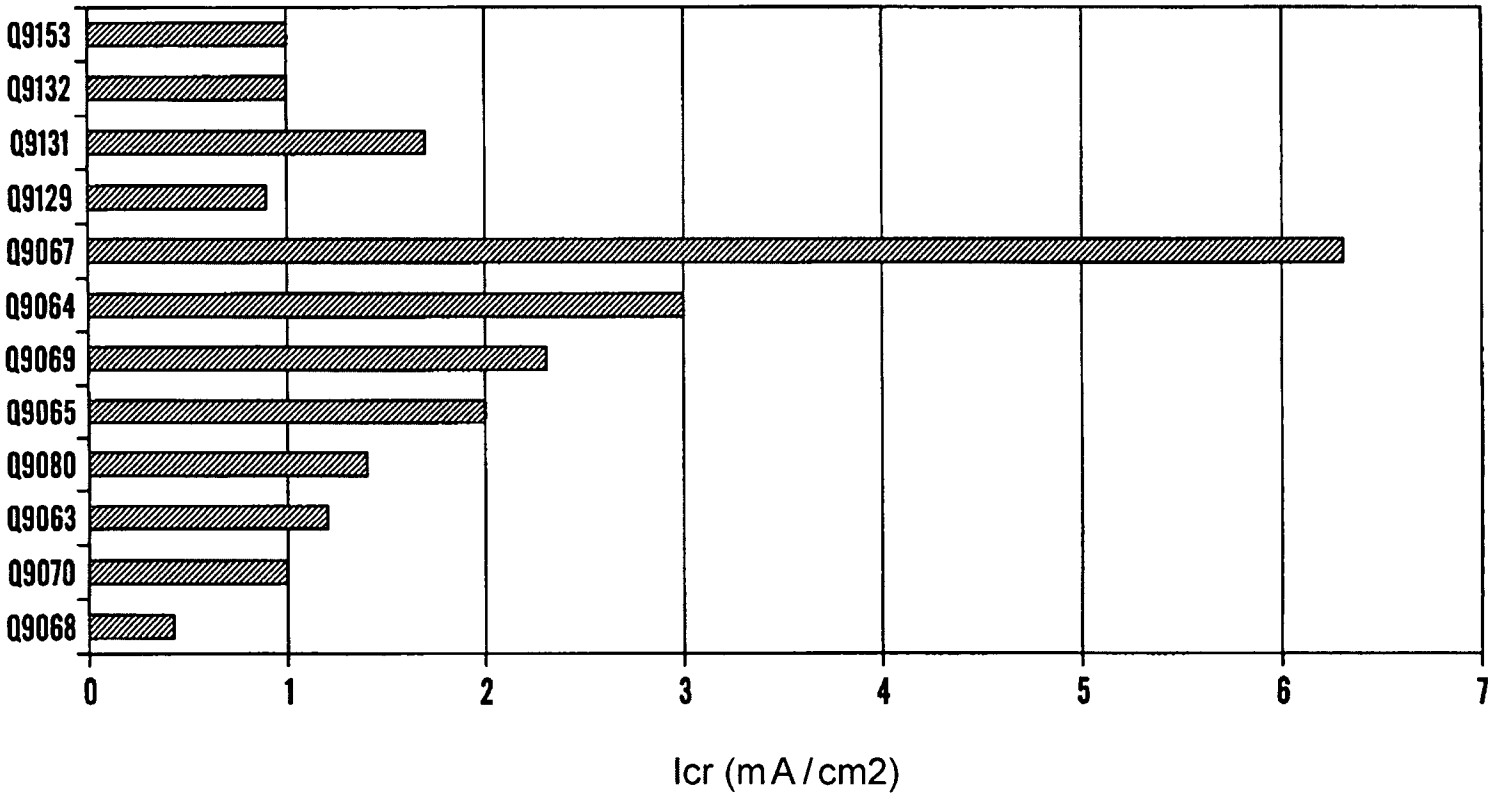

The results from this first test round are evident from the bar chart in FIG. 6A. From this bar chart it is evident that five steels had a better corrosion resistance than the reference material, Q9063, namely Q9068, Q9070, Q9129, Q9132 and Q9153.

Figure 6B:
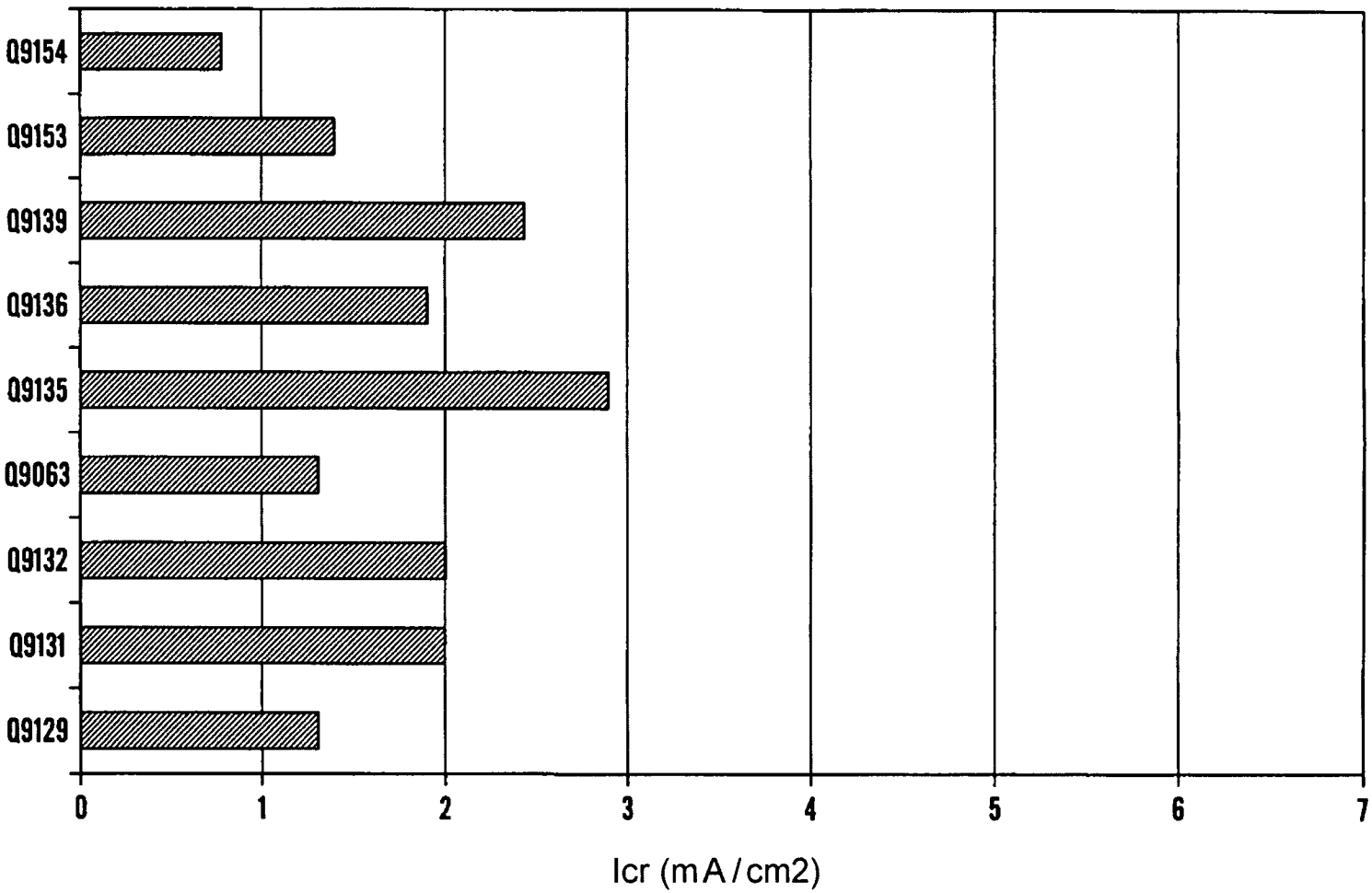

Still slower cooling rates t8/5 were employed in a second test round, see Table V and FIG. 6B.

TABLE V

| Heat treatment of polarization test specimens. Cooling in vacuum furnace | | | |
|---|---|---|---|
| Q-ingot No | Heat treatment | T8/5 (s) | Hardness (HRC) |
| 9063 | 1030° C./30 min + 570° C./2 × 2 h | 1880 | 38.9 |
| 9104 | 1030° C./30 min + 570° C./2 × 2 h | 1880 | 40.1 |
| 9129 | 950° C./30 min + 525° C./2 × 2 h | 1969 | 40.6 |
| 9131 | 950° C./30 min + 525° C./2 × 2 h + 535° C./2 h | 1969 | 39.6 |
| 9132 | 950° C./30 min + 525° C./2 × 2 h + 535° C./2 h | 1969 | 40.1 |
| 9135 | 950° C./30 min + 525° C./2 + 2 h | 1964 | 40.9 |
| 9136 | 950° C./30 min + 525° C./2 h + 500° C./2 h | 1964 | 39.0 |
| 9139 | 950° C./30 min + 525° C./2 × 2 h | 1964 | 42.1 |
| 9153 | 950° C./30 min + 535° C./2 × 2 h | 1885 | 40.3 |
| 9154 | 950° C./30 min + 540° C./2 × 2 h | 1863 | 39.0 |

FIG. 6B illustrates that best corrosion resistances were notified for samples of Q9063, 9129, 9153 and 9154.

Discussion

In the introductory disclosure of the invention there were listed a number of purposes of the invention. Besides a good machinability, the steel shall have a good ductility, a good corrosion resistance, and a good hardenability. It can be stated that it is an aim that the steel, besides a good machinability, shall have better ductility, corrosion resistance and hardenability than steel Q9063. Four steels satisfy those criteria, namely Q9068, Q9129, Q9153 and Q9154, which have a rather similar composition; although steel Q9154 has a higher nitrogen content and a lower content of carbon. On the basis of these experiences, it can be assumed that an optimal composition could be the following, namely 0.10 C, 0.075 N, 0.16 Si, 1.1 Mn, 13.1 Cr, 0.13 V, 1.8 Ni, 0.5 Mo, balance Fe and unavoidable impurities. An alternative could be a steel which contains 0.06 C and 0.14 Ni but as for the rest the same composition as the foregoing. Other alternatives—suitably conceivable nominal compositions—could be the following ones: 0.12 C, 0.20 Si, 1.30 Mn, 0.10 S, 13.4 Cr, 1.60 Ni, 0.50 Mo, 0.20 V, 0.10 N, balance iron and unavoidable impurities, and/or 0.14 C, 0.18 Si, 1.30 Mn, 0.10 S, 13.5 Cr, 1.67 Ni, 0.50 Mo, 0.22 V, 0.10 N, balance iron and unavoidable impurities.

Manufacturing of Steel at a Production Scale

A 35 tons heat of molten metal was manufactured in an electric arc furnace. Before tapping, the melt had the following chemical composition: 0.15 C, 0.18 Si, 0.020 P, 0.08 S, 13.60 Cr, 1.60 Ni, 0.48 Mo, 0.20 V, 0.083 N, balance Fe and unavoidable impurities. Of the melt there were manufactured ingots, which were forged to the shape of flat rods of varying dimensions. The forging did not cause any problems. The forged rods were tough-hardened to a hardness of about 380 HB through austenitizing at 950° C., holding time 2 h, fast quenching in air and tempering at 540° C., 2×2 h. The thus tough-hardened rods were machined to final gauges.

New Matter

Further research has revealed that the steel according to the present invention may obtain an improved machinability if the chemical composition contains in weight-%:

0.06-0.15C
$0.15 \leq C+N \leq 0.26$
0.5-1.5 Si
0.1-2.0 Mn
13.0-15.4 Cr
0.1-1.8 Ni
0.05-1.3 Mo
optionally vanadium up to max. 0.7 V
optionally one or more of the elements S, C and 0 in order to improve the machinability of the steel, in amounts up to
max. 0.25 S,
max. 0.01 (100 ppm) Ca,
max. 0.01 (100 ppm) 0, balance iron and unavoidable impurities. Further, the microstructure in tough-hardened condition contains a martensitic matrix with 5-30% ferrite.

According to a second aspect of this new variant of the invention, the composition is modified in order to reduce the cost of alloying elements, in particular molybdenum, but also nickel.

According to a third aspect of this new variant, an improved hot ductility may be obtained.

According to a fourth aspect of this new variant of the invention, a production method with improved production economy may be provided.

The steel according to the first aspect of this variant may obtain an improved machinability at the same as the other properties are sufficient. The steel of this second embodiment also aims to achieve one or several of the following effects:

an adequate corrosion resistance,
a hardness of 280-360 HB, preferably 290-352 HB, in tough hardened condition which gives the steel a beneficial combination of hardness and machinability,
an adequate hardenability,
an adequate ductility/toughness.

Carbon and nitrogen are elements which have a great importance for the hardness and ductility of the steel. Carbon is also an important hardenability promoting element. Carbon, however, binds chromium in the form of chromium carbides (M7C3-carbides) and may therefore impair the corrosion resistance of the steel. The steel therefore may contain max 0.15% carbon, preferably max 0.14% carbon (in this text always weight-% is referred to if not otherwise is stated). However, carbon also has some advantageous effects, such as to exist together with nitrogen as a dissolved element in the tempered martensite in order to contribute to the hardness thereof, and also acts as an austenite stabilizer and thence counteract ferrite in the structure. The minimum amount of carbon in the steel therefore shall be 0.06%, preferably at least 0.10%, and even more preferred at least 0.11%. Nominally the steel contains 0.12% C.

Nitrogen contributes to the provision of a more even, more homogenous distribution of carbides and carbonitrides by affecting the solidification conditions in the alloy system such that larger aggregates of carbides are avoided or are reduced during the solidifycation. The proportion of M23C6-carbides also is reduced in favour of M(C,N), i.e. vanadium-carbonitrides, which has a favourable impact on the ductility/toughness. In summary, nitrogen contributes to the provision of a more favourable solidification process implying smaller carbides and nitrides, which can be broken up during the working to a more finely dispersed phase. From these reasons nitrogen shall exist in an amount of at least 0.05%, preferably at least 0.07%, even more preferred at least 0.09%, but not more than 0.20%, preferably max 0.16%, and even more preferred 0.14%, nominally 0.10% N. At the same time the total amount of carbon and nitrogen shall satisfy the condition $0.15 \leq C+N \leq 0.26$. Preferably, C+N shall be at least 0.17% but suitably max 0.25%. Nominally, the steel contains 0.22% (C+N). In the hardened and tempered steel, nitrogen is substantially dissolved in the martensite in the form of nitrogen-martensite in solid solution and thence contributes to the desired hardness.

In summary, as far as the content of nitrogen is concerned, it can be stated that nitrogen shall exist in the said minimum amount in order to contribute to the desired corrosion resistance by increasing the so called PRE-value of the matrix of the steel, to exist as a dissolved element in the tempered martensite which contributes to the hardness of the martensite, and to form carbonitrides, M(C, N), to a desired degree together with carbon, but not exceed said maximum content, maximizing the content of carbon+nitrogen, where carbon is the most important hardness contributor.

Silicon increases the carbon activity of the steel and thence the tendency to precipitate more primary carbides. It also appears as if Si contributes to the improvement in machinability. Also, a positive effect may be obtained in the steels ability to adhesive wear and galling to the cutting tools, and chip breaking properties can be improved by Si. Further, silicon is a ferrite stabilizing element, and shall be balanced in relation to the ferrite stabilizing elements chromium and molybdenum in order for the steel to obtain a ferrite content of 5-30%, thereby providing the steel good machinability and hot ductility. At the same time the steel contains a lower content of carbon than is conventional in steels for the application in question. The steel therefore shall contain at least 0.5% Si, preferably at least 0.7% Si. Generally the rule shall apply that the ferrite stabilizing elements shall be adapted to the austenite stabilizing ones in order to obtain the desired formation of ferrite in the steel, and the maximum content of silicon is 1.5%, preferably max 1.2%.

Manganese is an element which promotes austenite and hardenability, which is a favourable effect of manganese, and can also be employed for sulphur refining by forming harmless manganese sulphides in the steel. Manganese therefore shall exist in a minimum amount of 0.1%, preferably at least 0.85%. Manganese, however has a segregation tendency together with phosphorous which can give rise to temperingembrittlement. Manganese therefore must not exist in an amount exceeding 2.0%, preferably max.1.8%.

Chromium is an imported alloying element according to this variant of the steel and is essentially responsible for provision of the stainless character of the steel, which is an important feature of holders and holder details for plastic moulding tools, as well as for the plastic moulding tool itself, which often is used in damp environments, which may cause less corrosion resistant steels to rust.

Chromium also is the most important hardenability promoting element of the steel. However, no substantial amounts of chromium are bound in the form of carbides, because the steel has a comparatively low carbon content, wherefore the steel can have a chromium content as low as 13.0% and nevertheless get a desired corrosion resistance. Preferably the steel, however, contains at least 13.5% and more preferred at least 14.0% chromium. The upper limit is determined in the first place by cost reasons, reduced hardness due to carbide precipitation, and the risk for chromium segregations. The steel therefore must not contain more than max. 15.4% Cr, preferably max. 14.8% Cr, and even more preferred max 14.5% Cr. Nominally, the steel contains 14.3% Cr.

Nickel should exist in the steel in a minimum amount of 0.1%, preferably at least 0.15%. From cost reasons, however, the content should be limited to max. 1.8%, preferably to max. 1.5%. Preferably the nickel content is 0.8-1.0%, and even more preferred 0.9%.

According to a conceived embodiment, the Ni content may be reduced even further, to an interval of 0.15-0.25%, preferably 0.20% Ni. In order for the steel to obtain the desired hardenability, the low Ni content preferably is compensated by a Mn content of 1.4-1.6 Mn, preferably 1.5 Mn, possibly also with a Si content of 1.05-1.15 Si, preferably 1.10 Si.

In a variant of the steel, the steel does not contain any intentionally added vanadium. Optionally, the steel of the invention also may contain an active content of vanadium in order to bring about a secondary hardening through precipitation of secondary carbides in connection with the tempering operation, wherein the tempering resistance is increased. Vanadium, when present, also acts as a grain growth inhibitor through the precipitation of MC-carbides. If the content of vanadium is too high, however, there will be formed large primary MC-carbonitrides during the solidification of the steel, and this also occurs if the steel is subjected to ESR-remelting, which primary carbides will not be dissolved during the hardening procedure. For the achievement of the desired secondary hardening and for the provision of a favourable contribution to the grain growth inhibition, but at the same time avoiding formation of large, undissolvable primary carbides in the steel, the optional content of vanadium should lie in the range 0.07-0.7% V. A suitable content is 0.10-0.20% V, nominally about 0.15% V.

Preferably, the steel also contains an active content of molybdenum, e.g. at least 0.05%, preferably at least 0.10%, in order to give a hardenability promoting effect. Molybdenum up to an amount of at least 1.3% also promotes the corrosion resistance but may have effect also if the content is higher. When tempering, molybdenum also contributes to increasing the tempering resistance of the steel, which is favourable. On the other hand, a too high content of molybdenum may give rise to an unfavourable carbide structure by causing a tendency to precipitation of grain boundary carbides and segregations. The steel shall contain a balanced content of molybdenum in order to take advantage of its favourable effects but at the same time avoid those ones which are unfavourable. An optimal content may lie in the range 0.10-0.40%, probably in the range 0.15-0.25% Mo. Nominally, the steel contains 0.20% Mo.

Normally, the steel does not contain tungsten in amounts exceeding the impurity level, but may possibly be tolerated in amounts up to 1%.

The steel of the invention shall be possible to be delivered in its tough-hardened condition, which makes it possible to manufacture large sized holders and mould tools through machining operations. The hardening is carried out through austenitizing at a temperature of 900-1050° C., preferably at 950-1025° C., or at about 1000° C., followed by cooling in oil or in a polymer bath, by cooling in gas in a vacuum furnace, or in air. The high temperature tempering for the achievement of a tough hardened material with a hardness of 280-360 HB, preferably 290-352 HB, which is suitable for machining operations, is performed at a temperature of 510-650° C., preferably at 540-620° C., for at least one hour, preferably through double tempering; twice for two hours.

The steel may, according to a preferred embodiment, also contain an active content of sulphur, possibly in combination with calcium and oxygen, in order to improve the machinability of the steel in its tough hardened condition. In order to obtain further improvement in terms of machinability, the steel should contain at least 0.11% S if the steel does not also contain an intentionally added amount of calcium and oxygen. The maximum sulphur content of the steel is 0.25%, preferably max 0.15%, when the steel is intentionally alloyed with a content of sulphur. A suitable sulphur content in this case may be 0.13%. Also a non-sulphurized variant of the steel, however, can be conceived. In this case the steel does not contain sulphur above impurity level, and nor does the steel contain any active contents of calcium and/or oxygen.

It is thus conceivable that the steel may contain 0.035-0.25% S in combination with 3-100 weight-ppm Ca, preferably 5-75 ppm Ca, suitably max. 40 ppm Ca, and 10-100 ppm 0, wherein said calcium, which may be supplied as silicon-calcium, CaSi, in order to globulize existing sulphides to form calcium sulphides, counteracts that the sulphides get a non-desired, elongated shape, which might impair the ductility.

Further characteristics, aspects and features of the steel according to the invention, and its usefulness for the manufacturing of holders and moulding tools, will be explained more in detail in the following through a description of performed experiments and achieved results.

Material

13 Q-ingots (50 kg laboratory heats) with compositions according to Table VI manufactured in three new rounds. In the first round, four ingots were manufactured where ingot Q9261 is a reference composition in accordance to reference material No. 1. Ingot No. Q9262-Q9264 having chemical compositions where C, Ni, Mo, V and N are lowered and Si and Mn are increased. However, examination of these three Q-ingots showed that the microstructure did not contain any expected ferrite and therefore a new test round was performed.

In the second round (Q9271-Q9283) seven ingots were manufactured. Q9271 and Q9283 are reference materials where Q9283 contains a higher amount of S which is beneficial for the machinability. Among the test materials, carbon were slightly varied, Si were added in significantly higher amounts, Ni and Mo were reduced and Cr and N were varied. It was revealed that the alloy having the most interesting features was Q9272.

In the final round (Q9284-Q9285) the chemical compositions of Q9272 formed the basis for the two new Q-ingots. The C content was lowered in combination with a higher N content, the Mn and Cr contents were increased and Si, S, Ni, Mo and V were slightly varied in order to try to optimize the composition.

The Q-ingots were forged to the shape of bars of size 60×40 mm, whereupon the rods were cooled in air to room temperature. The rods were heated to 740° C., cooled at a cooling rate of 15° C./h to 550° C., there from free cooling in air to room temperature. The ferrite content has been measured after hardening and tempering.

TABLE VI

Test materials; chemical composition in weight-%, balance Fe and unavoidable impurities

| Q-ingot No. | C | Si | Mn | S | Cr | Ni | Mo | V | N |
|---|---|---|---|---|---|---|---|---|---|
| Q9261 = ref | 0.15 | 0.09 | 0.89 | 0.14 | 12.9 | 1.69 | 0.55 | 0.22 | 0.12 |
| Q9262 | 0.13 | 0.24 | 1.10 | 0.14 | 13.0 | 0.84 | 0.21 | 0.15 | 0.10 |
| Q9263 | 0.13 | 0.24 | 1.07 | 0.13 | 12.9 | 0.84 | 0.21 | 0.15 | 0.10 |
| Q9264 | 0.12 | 0.26 | 1.11 | 0.14 | 13.0 | 0.84 | 0.11 | 0.14 | 0.07 |
| Q9271 = ref | 0.14 | 0.12 | 0.90 | 0.10 | 13.2 | 1.65 | 0.52 | 0.24 | 0.08 |
| Q9272 | 0.15 | 0.93 | 0.90 | 0.13 | 14.5 | 0.96 | 0.22 | 0.33 | 0.08 |
| Q9273 | 0.13 | 0.93 | 0.84 | 0.12 | 13.5 | 0.08 | 0.21 | 0.21 | 0.08 |
| Q9274 | 0.15 | 0.75 | 0.78 | 0.13 | 14.7 | 0.07 | 0.20 | 0.20 | 0.10 |
| Q9275 | 0.12 | 0.79 | 0.90 | 0.13 | 15.8 | 0.95 | 0.21 | 0.20 | 0.06 |
| Q9276 | 0.07 | 0.78 | 0.90 | 0.11 | 14.4 | 0.93 | 0.20 | 0.20 | 0.05 |
| Q9283 = Q9271 + S | 0.12 | 0.09 | 1.16 | 0.13 | 13.4 | 1.68 | 0.53 | 0.25 | 0.09 |
| Q9284 | 0.12 | 0.87 | 1.09 | 0.12 | 14.8 | 0.96 | 0.27 | 0.22 | 0.12 |
| Q9285 | 0.11 | 0.82 | 1.09 | 0.10 | 14.6 | 0.90 | 0.22 | 0.21 | 0.12 |

Hardness after Heat Treatment

Figure 7A:
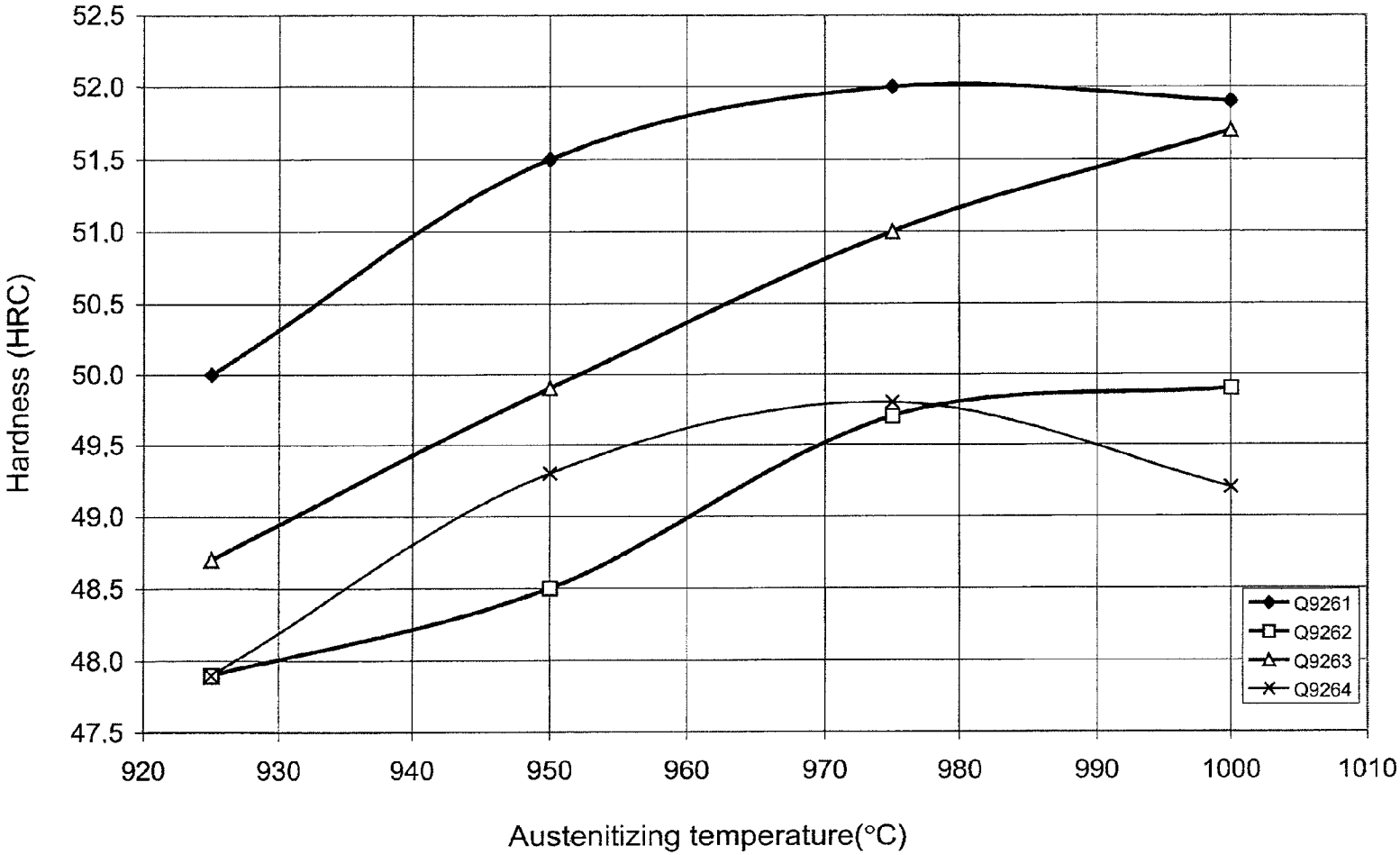
FIG. 7A is a chart showing the hardness of a first set of steels, produced in the form of so called Q-ingots (50 kg laboratory heats), after hardening but before tempering, versus the austenitizing temperature at a holding time of 30 min.
Figure 7B:
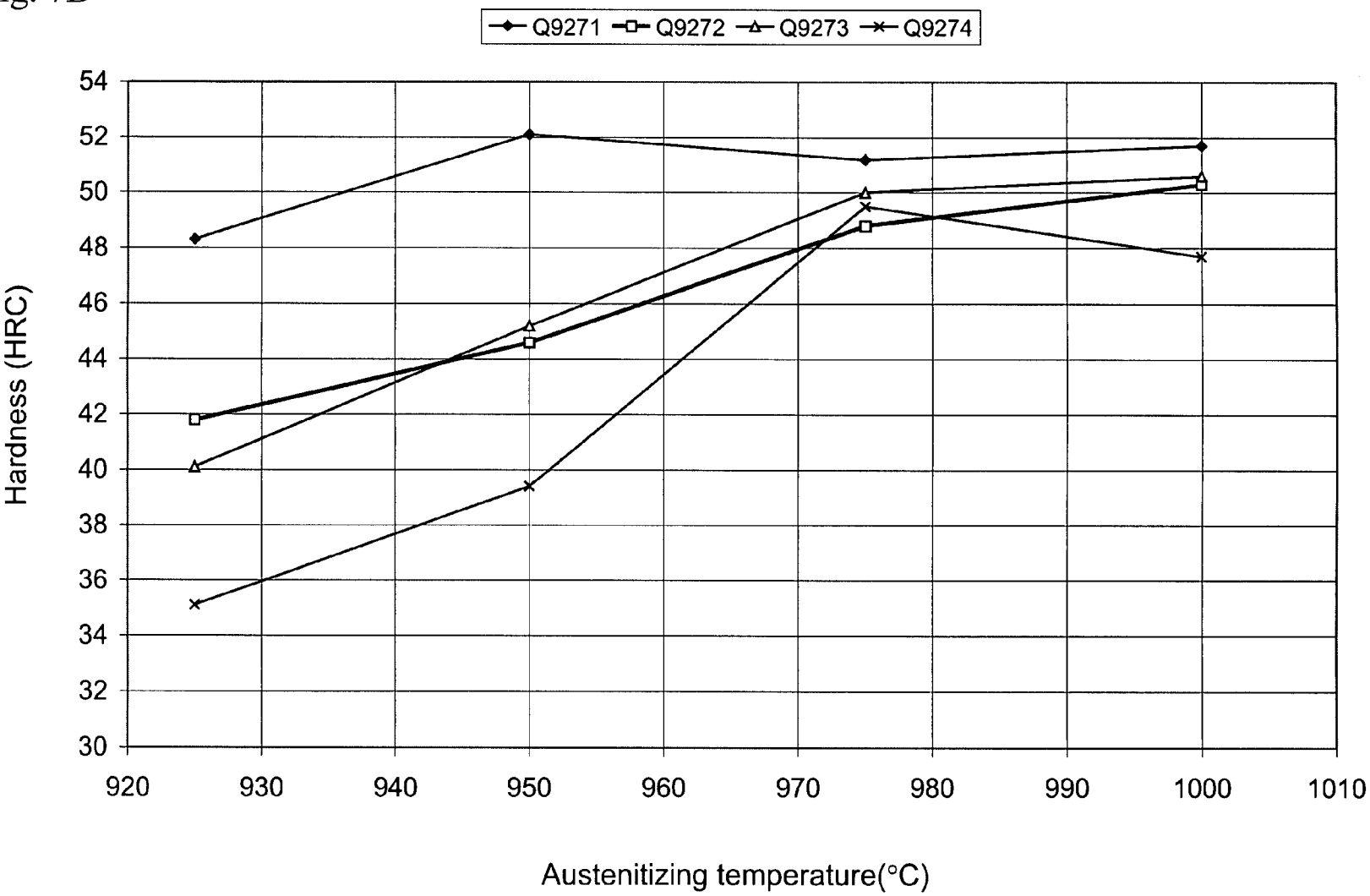
FIG. 7B shows corresponding graphs for another number of tested steels manufactured as Q-ingots.
Figure 7C:
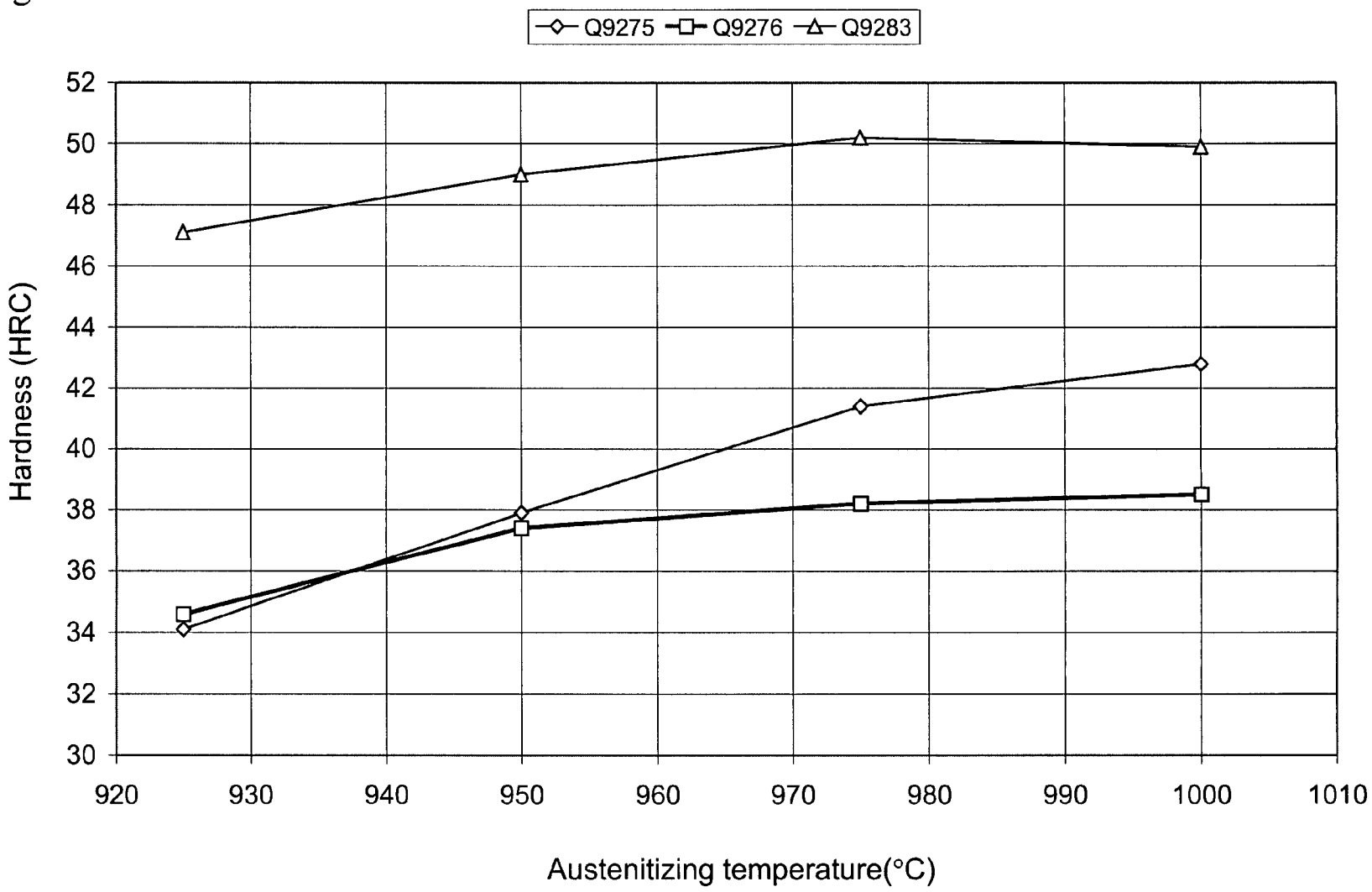
FIG. 7C shows corresponding graphs for yet another number of tested steels manufactured as Q-ingots.

The hardness versus the austenitizing temperature is shown in FIG. 7A-7C. It is evident from the charts of these drawings that the reference steels (Q9261, Q9271 and Q9283) have the highest hardness. It is also evident that the hardness increases with increasing austenitizing temperature. However, most of the steels according to the new variant of the invention require a somewhat higher austenitizing temperature to obtain approximately the same hardness as the reference materials. In that case it may be more appropriate to choose 1000° C. as an austenitizing temperature.

Figure 8:
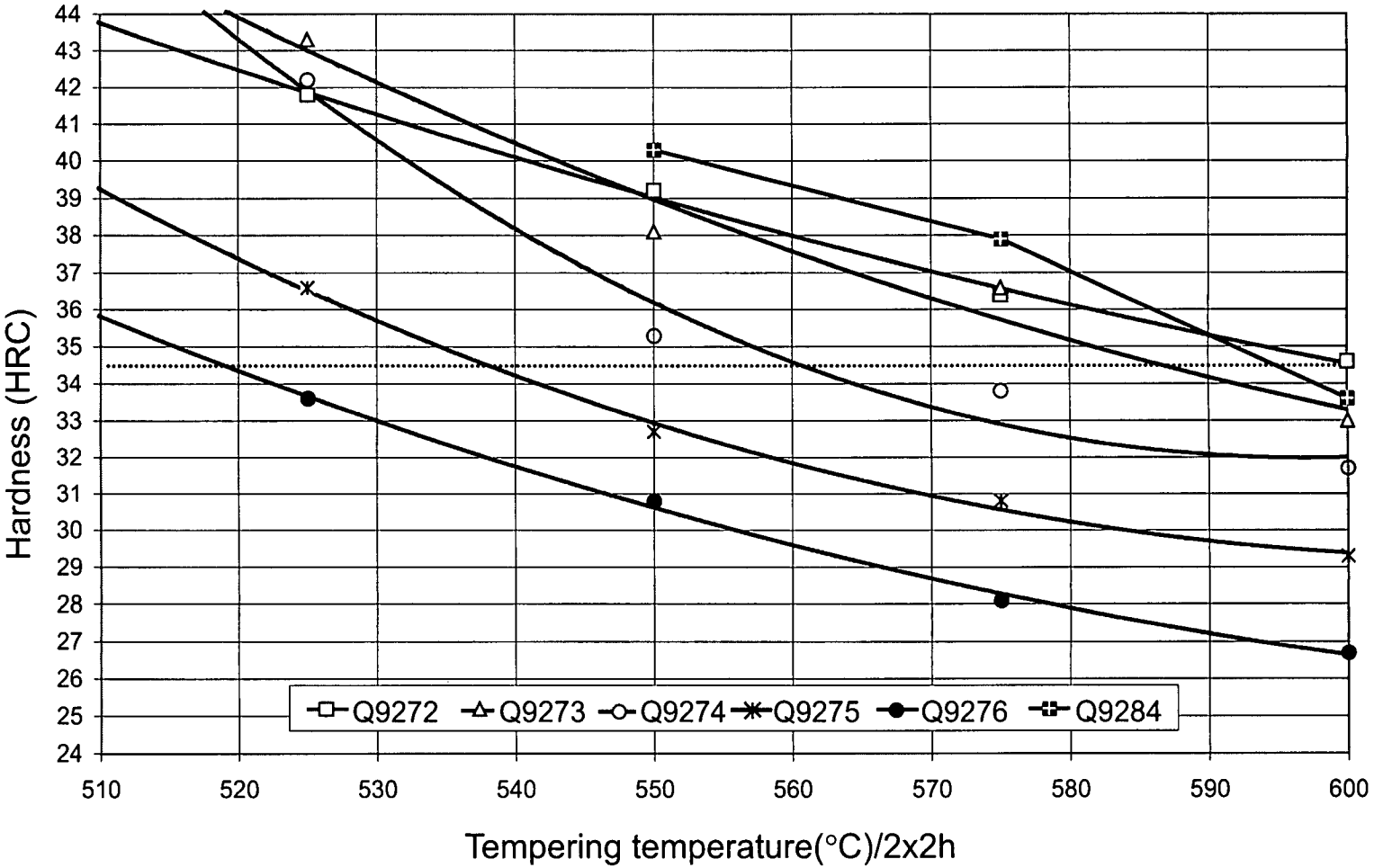
FIG. 8 shows tempering curves for those steels in the second set which have been hardened from 1000° C.

The hardness after tempering of some of the steels which had been hardened from 1000° C. are shown in FIG. 8. The conclusion can be drawn from the tempering curves that these steels can be tempered down to 34 HRC through tempering in the temperature range 520-600° C. As is evident from the figure, the inventive steels Nos. Q9272, Q9273, Q9274 and Q9284 cari be tempered at higher temperatures than the other inventive steels and still obtain a high hardness which is beneficial from a stress relief point of view.

An appropriate hardness of the steel after tough-hardening is about 35-38 HRC, (i.e. 320-350 HB). In Table VII below, the heat treatments are stated which provide the said hardness to the different steels.

TABLE VII

| Heat treatment for tough-hardening, measured ferrite, percent by volume | | |
|---|---|---|
| Q-ingot No. | Heat treatment | Ferrite content % |
| Q9261 | 950° C. + 580° C./2 × 2 h | 0 |
| Q9262 | 950° C. + 565° C./2 × 2 h | 0 |
| Q9263 | 950° C. + 570° C./2 × 2 h | 0 |
| Q9264 | 950° C. + 565° C./2 × 2 h | 0 |
| Q9271 | 950° C. + 585° C./2 × 2 h | 0 |
| Q9272 | 950° C. + 555° C./2 × 2 h | 10 |
| Q9273 | 950° C. + 545° C./2 × 2 h | 20 |
| Q9274 | 950° C. + 535° C./2 × 2 h | 20–50 |
| Q9275 | 1000° C. + 540° C./2 × 2 h | 30 |
| Q9276 | 1000° C. + 520° C./2 × 2 h | 25 |
| Q9283 | 950° C. + 585° C./2 × 2 h | 0 |

Hardenability

Figure 9:
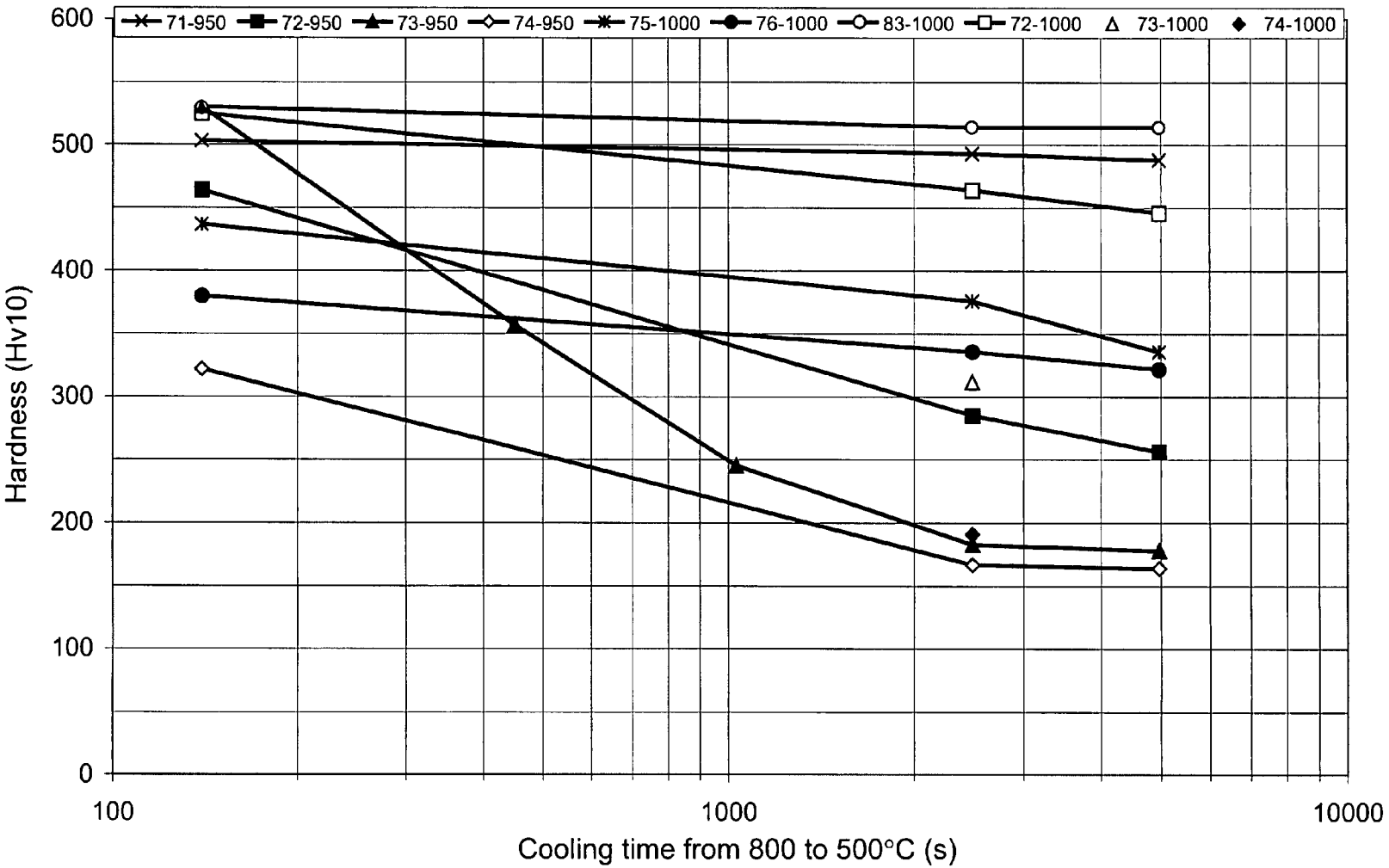
FIG. 9 is a chart which showing hardenability curves for the steels, FIG. 10 A-C are bar charts illustrating results from machinability testing of steels, manufactured at production scale.

The hardness after hardening is shown in the hardenability curves of FIG. 9. The austenitizing temperatures are indicated in the figure from which temperatures the samples have been cooled at different rates. From the figure it is evident that steel Q9272 austenitized at 1000° C. has the best hardenability among the inventive steels. This steel and possibly also Q9275 and Q9276 have sufficient hardenability in order to be hardened at relatively thick dimensions. The other steels may be used for less thick dimensions. The steels in the figure which shows the lowest hardenability have low Ni content. The best hardenability is obtained by commercial steel No. 1 which is represented by the hardening curves for Q9283 and Q9271.

Machinability

The machinability of the inventive steels were examined by different milling operations and compared to the machinability of some commercial steels. The chemical composition of the tested steels are shown in Table VIII.

TABLE VIII

| Steel composition of examined steels at production scale | | | | | | | | | | | |
|---|---|---|---|---|---|---|---|---|---|---|---|
| | C | Si | Mn | S | Cr | Ni | Mo | V | Cu | N | O ppm |
| Steel No 1 | 0.15 | 0.18 | 1.26 | 0.08 | 13.6 | 1.6 | 0.48 | 0.20 | 0.15 | 0.083 | |
| Steel No. 2 | 0.045 | 0.40 | 0.92 | 0.14 | 12.8 | 0.44 | 0.15 | 0.049 | 0.26 | 0.039 | 99 |
| Steel No. 3 | 0.046 | 0.43 | 1.30 | 0.14 | 12.7 | 0.18 | 0.02 | 0.032 | 0.63 | 0.08<br>0.12 | 28 |
| Steel No. 4 | 0.14 | 0.89 | 1.11 | 0.14 | 14.3 | 0.96 | 0.19 | 0.15 | | 0.071 | 34 |

The commercial steels were obtained from the commercial market and no heat treatment or other treatment was performed to them. The inventive steel was manufactured from a melt of 6 tons and ingots were cast which were manufactured to test pieces by either hot rolling or forging at a temperature of 1240° C. The test pieces were cooled to an isothermal annealing temperature of 650° C. and were subjected to an isothermal annealing at the isothermal annealing temperature during 10 h, thereafter cooled in free air to room temperature. The test pieces were then hardened by austenitizing at a temperature of 1000° C., 30 min, and tempered twice during two hours at a temperature of 550-620° C.

Figure 10A:
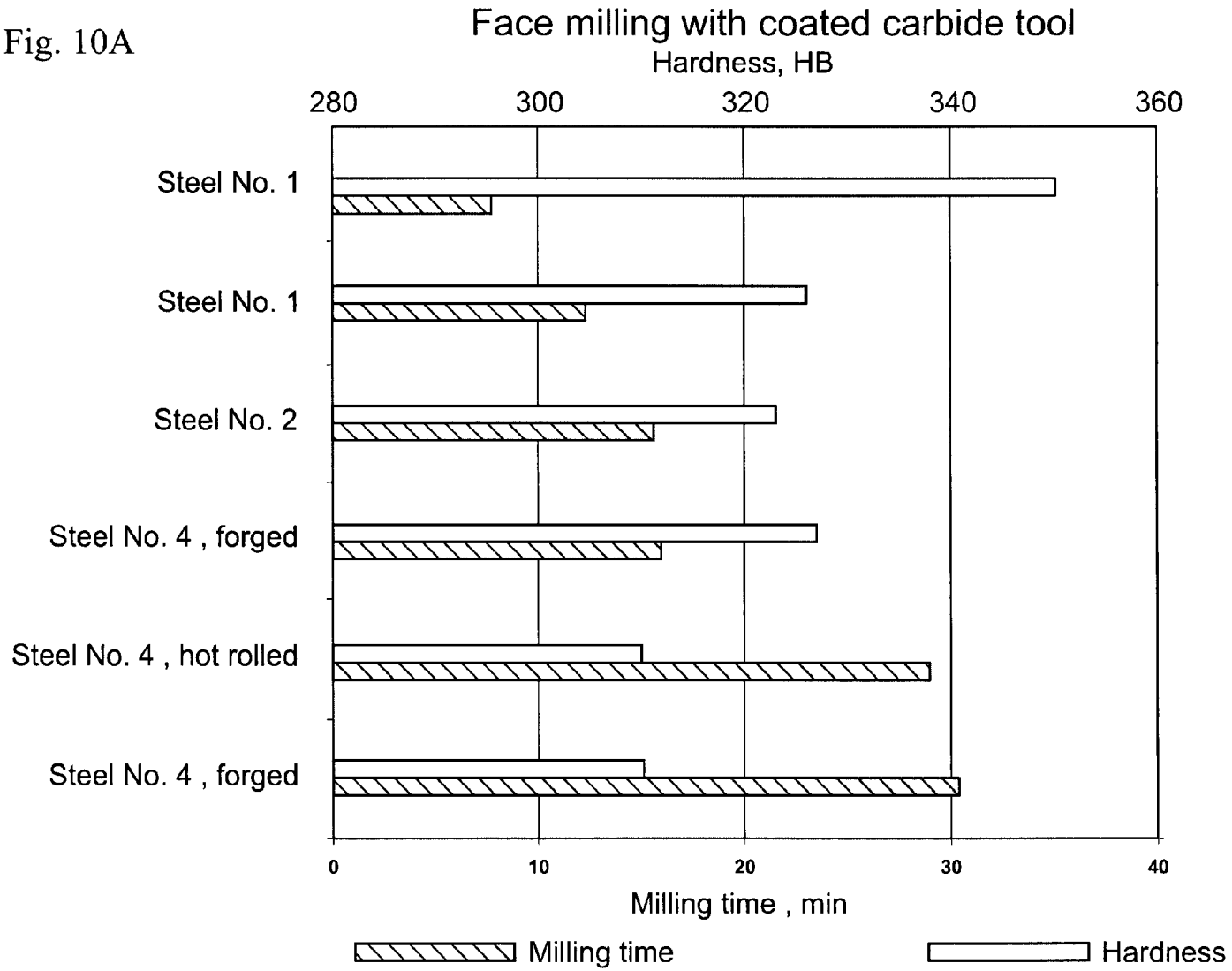
Figure 10B:
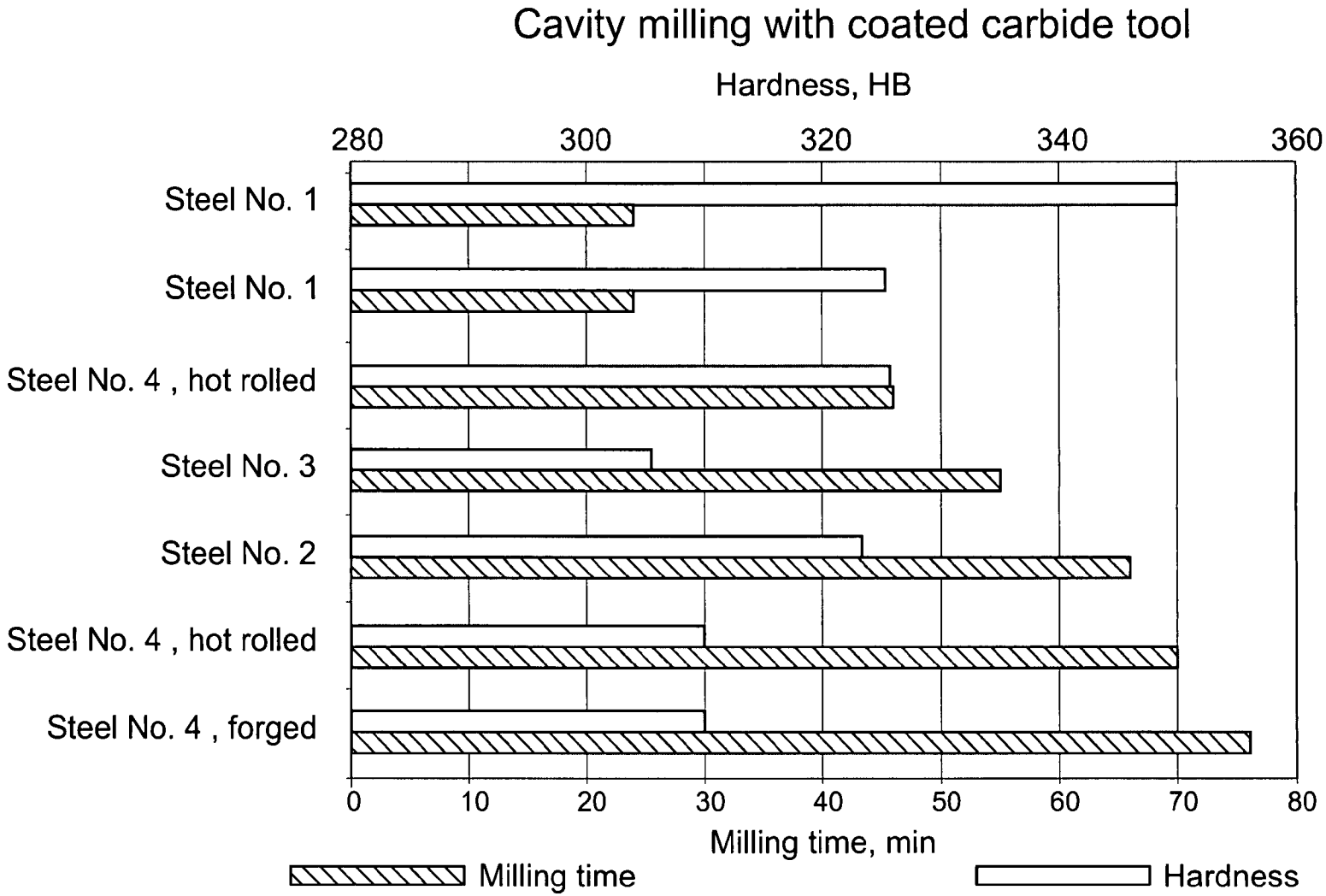
Figure 10C:
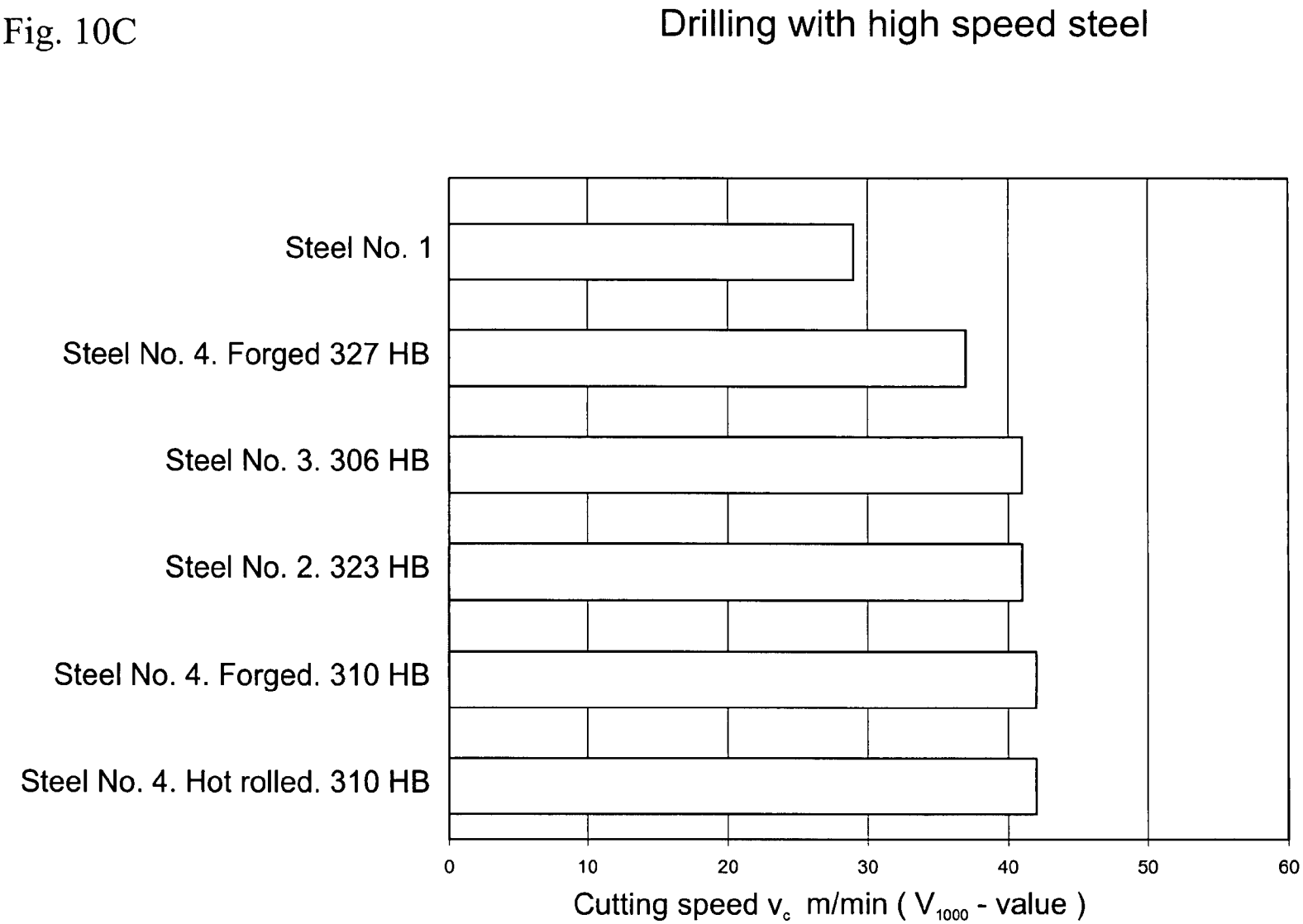
Figure 11:
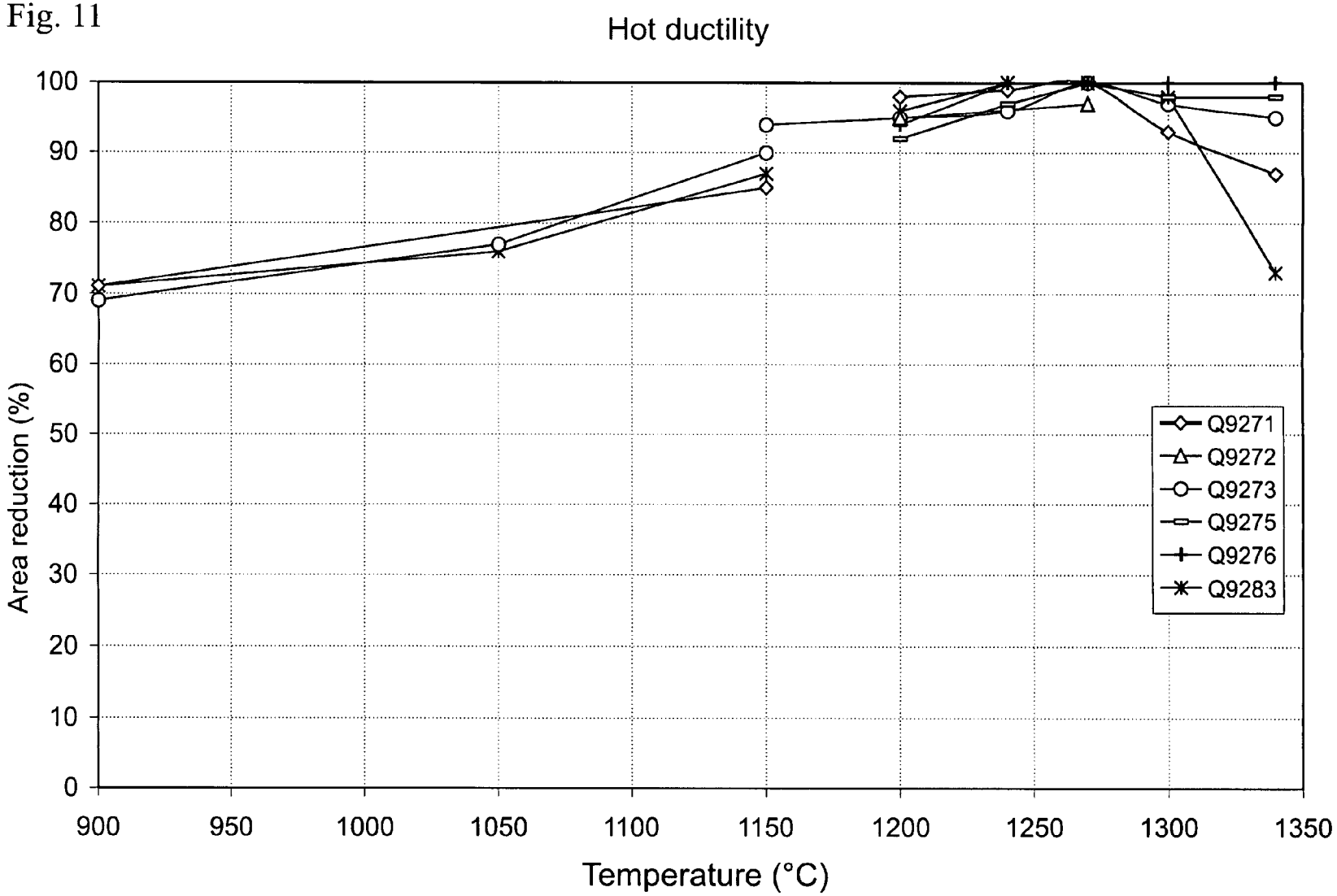
FIG. 11 is a chart which shows the hot ductility for a number of the steels manufactured as Q-ingots.

FIG. 10A shows the result from face milling with coated carbide tools. The cutting data were as follows:

Machine type=Sajo VM 450
Milling cutter=Sandvik Coromant R245-80Q27-12M, Ø80 mm, 6 inserts
Cutting speed, vc=250 m/min
Tooth feed, fz=0.2 mm/tooth
Axial depth of cut, ap=2 mm
Radial depth of cut, ae=63 mm
Wear criteria=flank wear 0.5 mm As is evident from FIG. 10 A the inventive steel has equal or better machinability than the commercial steels. Particularly the inventive steels with somewhat lower hardness than the commercial steels shows superior face milling properties.

FIG. 10 B shows the results from cavity milling with coated carbide tools. The cutting data were as follows:

Cutting speed, vc=Varying
Tooth feed, fz=0.25 mm/tooth
Axial depth of cut, ap=2 mm
Radial depth of cut, ae=12 mm
Milling tool: Coromant R200-028A32-12M, Ø 40 mm, l=145 mm
Carbide grade: Coromant RCKT 1204 MO-PM 4030
Wear criteria: VBmax 0.5 mm FIG. 10 B shows that the inventive steel may obtain cavity milling properties which are equal or even better than the commercial steel No. 2 and 3, and that the inventive steel is superior the commercial steel No. 1.

In a final test, drilling with high speed steel were performed and the results are shoen in FIG. 10 C. It is evident from these tests that the inventive steel can obtain equal or better drilling properties as the commercial steels.

The drilling data is as follows:

Drill type: Wedevåg 120
uncoated HSS Ø 5 mm
Cutting speed, vc: 26 in/min.
Feed rate, f: 0.15 mm/rev.
Drill depth: 12.5 mm To sum up, the results of the machinability tests are presented in Table IX. In the Table, the results for the steels are presented by a value, 1-5, where the value 5 represents the best result. In Table IX, the results of steel No. 4 in forged condition are shown at different hardness in accordance to FIGS. 10 A-C, the hardness in forged condition being 310 HB and 327 HB respectively.

TABLE IX

| Performed at test production scale | | | | |
|---|---|---|---|---|
| Steel | Hardness | Face milling | Drilling | Cavity milling |
| No. 2 | 4 | 3 | 5 | 4 |
| No. 3 | 3 | — | 5 | 3 |
| No. 1 | 4 | 3 | 4 | 2 |
| No. 1 | 5 | 2 | — | 2 |

TABLE IX-continued

| Performed at test production scale | | | | |
|---|---|---|---|---|
| Steel | Hardness | Face milling | Drilling | Cavity milling |
| No. 4 Hot rolled | 3 | 5 | 5 | 5 |
| No. 4 Forged | 3 | 5 | 5 | 5 |
| No. 4 Forged | 4 | 3 | 4 | 3 |

Microstructure

Figure 12:
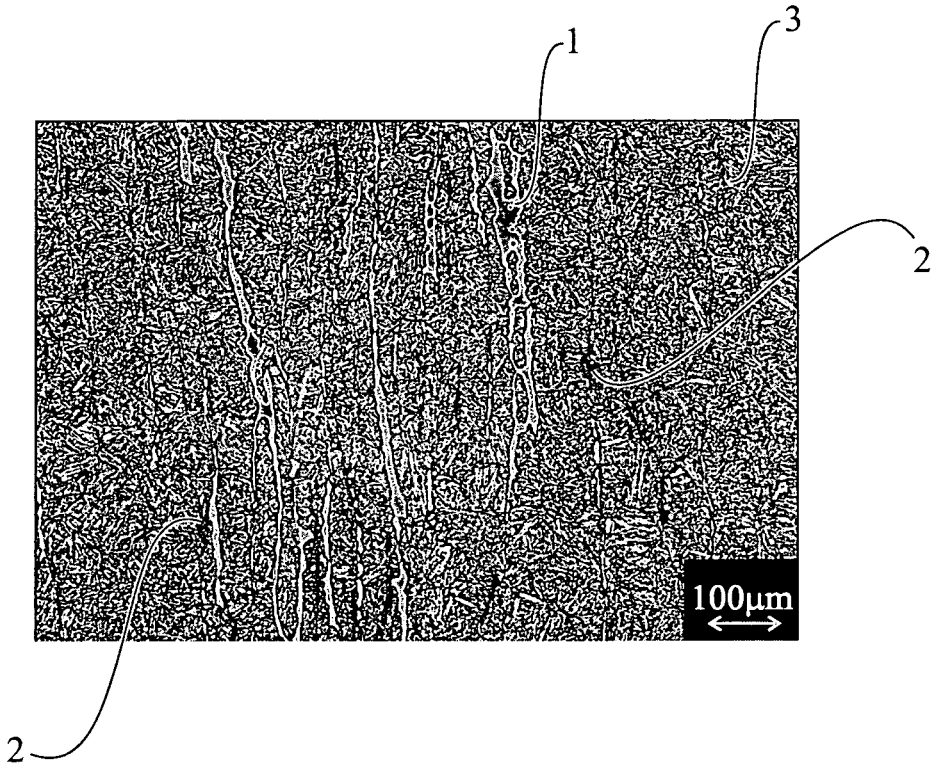
FIG. 12 is a photo showing the microstructure for a preferred embodiment of the new variant of the steel.

The microstructure in tough hardened condition of a steel with a chemical composition according to Steel No. 4 is shown in FIG. 12. The microstructure consists of a matrix of martensite 3. Further, the matrix contains approximately 10% ferrite 1 and some manganese sulphides 2, MnS, can be seen. The tough hardening was performed at an austenitizing temperature of 1000° C., 30 min and tempering at 590° C., 2×2 h. The manufacturing process includes hot rolling and cooling in air. The test piece had a dimension of 306×54 mm obtained by hot rolling.

Corrosion Tests

Polarization curves were established in a first test round for the steels given in Table X in terms of critical current density, Icr, for the evaluation of the corrosion resistance of the steels. As far as this method of measurement is concerned, the rule is that the lower Ire is, the better is the corrosion resistance. The test specimens were subjected to different cooling rates.

TABLE X

| Heat treatment of polarization test specimens. Cooling in vacuum furnace | | | |
|---|---|---|---|
| Q-ingot No. | Heat treatment | Hardability (HRC) (???) | ikr (mA/cm2) |
| Q9261 | 950° C. + 580° C./2 × 2 h | 34.6 | 3.49 |
| Q9262 | 950° C. + 565° C./2 × 2 h | 35.8 | 7.23 |
| Q9263 | 950° C. + 570° C./2 × 2 h | 34.5 | 6.84 |
| Q9264 | 950° C. + 565° C./2 × 2 h | 34.3 | 7.90 |
| Q9271 | 950 + 585/2 × 2 h | 35.9 | 1.70 |
| Q9272 | 950 + 555/2 × 2 h | 36.7 | 5.40 |
| Q9273 | 950 + 545/2 × 2 h | 36.5 | 6.28 |
| Q9274 | 950 + 545/2 × 2 h | 31.9 | 4.29 |
| Q9275 | 1000 + 540/2 × 2 h | 34.2 | 4.76 |
| Q9276 | 1000 + 520/2 × 2 h | 35.7 | 2.53 |
| Q9283 | 950 + 585/2 × 2 h | 34.3 | 3.08 |

The results showed that the steels Q9274, Q9275 and Q9276 had better corrosion resistance than most of the other tested steels, and that Q9276 had best corrosion resistance among the inventive steels, even better than reference materials No. Q9261 and Q9283.

Figure 13:
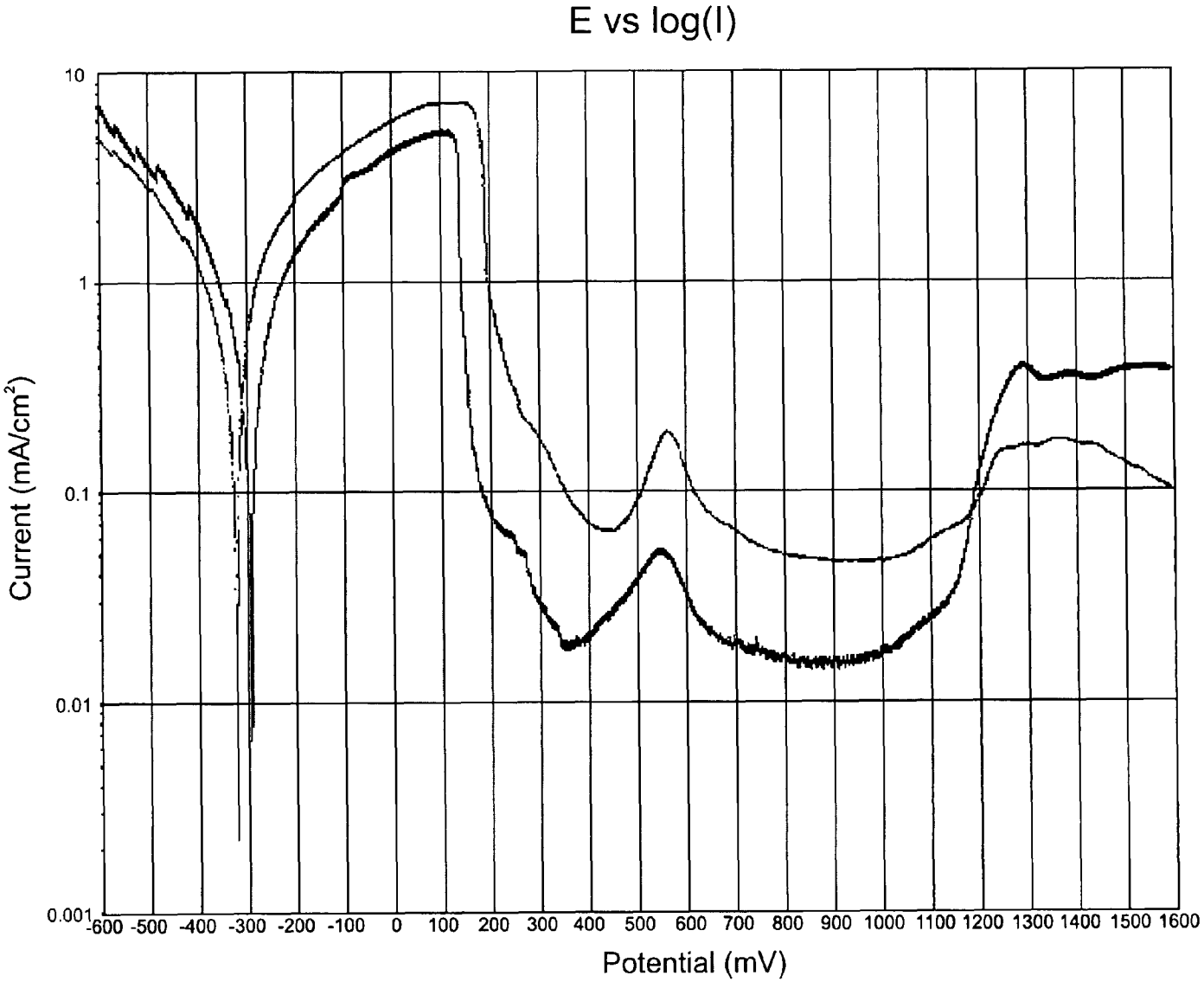
FIG. 13 shows polarisation curves for the inventive steel and a reference steel.

The resistance to general corrosion was investigated by polarisation testing in 0.05 M, $H_2SO_4$, pH=1.2, for the inventive steel No. 4 and the commercial steel No. 3. The polarisation curves are shown in FIG. 13, and it is evident that the inventive steel had better resistance to general corrosion than the commercial steel.

Manufacturing Process

In the process for producing holders, holder details for plastic moulding tools and moulding tools, a holder base, a holder detail base and a moulding tool base is manufactured from a steel alloy which contains in weight-%:

0.06-0.15 C
0.15<C+N<0.26
0.5-1.5 Si
0.1-2.0 Mn
13.0-15.4 Cr
0.1-1.8 Ni
0.05-1.3 Mo
optionally vanadium up to max. 0.7 V,
optionally one or more of the elements S, Ca and 0 in order to improve the machinability of the steel, in amounts up to:
max. 0.25 S,
max. 0.01 (100 ppm) Ca,
max. 0.01 (100 ppm) 0,
balance iron and unavoidable impurities.

The steel of the invention can be manufactured conventionally at a production scale by manufacturing a metal melt in the normal way, said melt having a chemical composition according to the invention, and casting the melt into large ingots or casting the melt continuously. It is also possible to cast electrodes of the molten metal and then remelting the electrodes through Electro-Slag-Remelting (ESR). It is also possible to manufacture ingots powder-metallurgically through gas-atomization of the melt to produce a powder, which then is compacted through a technique which may comprise hot isostatic pressing, so called HIPing, or, as an alternative, manufacture ingots through sprayforming.

Said process further comprises the steps of hot working said steel alloy, at a temperature range of 1100-1300° C., preferably 1240-1270° C., cooling said steel alloy to a temperature of max 100° C., tempering said steel alloy twice during 2 hours at a temperature of 510-650° C., preferably 540-620° C., and forming the holder base and holder detail base and moulding tool base by machining operation to holders and holder details for plastic moulding tools and moulding tools.

In an alternative process for producing holders, holder details for plastic moulding tools and moulding tools, a holder base and a holder detail base and a moulding tool base is manufactured from a ingot containing a steel alloy according to the above, said process comprising the steps of hot working said steel alloy at a temperature. range of 1100-1300° C., preferably 1240-1270° C., cooling said steel alloy to an isothermal annealing temperature of 550-700° C., preferably 600-700° C., subjecting said steel alloy to an isothermal annealing at said isothermal annealing temperature during 5-10 h, cooling said alloy by free air cooling to room temperature, hardening said steel alloy by austenitizing at a temperature of 900-1050° C., preferably 950-1025° C., and even more preferred at 1000° C., 30 min, and tempering twice during 2 hours at a temperature of 510-650° C., preferably 540-620° C., and forming the holder base and holder detail base and moulding tool base by machining operation to holders and holder details for plastic moulding tools and moulding tools.

The invention claimed is:

1. A steel alloy, consisting essentially of, in weight-%:
0.06-0.14 C,
0.08-0.12 N,
0.18≤C+N≤0.26,
0.1-1.0 Si,
0.1-2.0 Mn,
13.1-13.7 Cr,
1.5-1.7 Ni,
0.4-0.6 Mo,
max. 0.7 V,
0.035-0.15 S, and
balance iron and unavoidable impurities,
wherein, after hardening and tempering, the steel alloy has a substantially martensitic matrix,
wherein, after hardening and tempering, the steel alloy is essentially void of ferrite, and wherein, after hardening and tempering, the steel alloy is essentially void of spots having a hardness substantially higher than a hardness of the martensitic matrix.

2. The steel alloy according to claim 1, wherein the steel alloy consists essentially of, in weight-%, 0.07-0.13 C.

3. The steel alloy according to claim 1, wherein the total amount of C+N satisfies the condition, in weight-%, 0.18<C+N<0.23.

4. The steel alloy according to claim 1, wherein the steel alloy consists essentially of, in weight-%, 0.1-0.7 Si.

5. The steel alloy according to claim 4, wherein the steel alloy contains consists essentially of, in weight-%, 0.1-0.4 Si.

6. The steel alloy according to claim 4, wherein the steel alloy contains consists essentially of, in weight-%, max. 0.5 Si.

7. The steel alloy according to claim 1, wherein the steel alloy consists essentially of, in weight-%, max. 1.5 Mn.

8. The steel alloy according to claim 7, wherein the steel alloy consists essentially of, in weight-%, max. 1.3 Mn.

9. The steel alloy according to claim 1, wherein the steel alloy contains consists essentially of, in weight-%, at least 0.07 V.

10. The steel alloy according to claim 9, wherein the steel alloy consists essentially of at least 0.10 V.

11. The steel alloy according to claim 10, wherein the steel alloy consists essentially of, in weight-%, 0.10-0.30 V.

12. The steel alloy according to claim 11, wherein the steel alloy consists essentially of, in weight-%, 0.10-0.20 V.

13. The steel alloy according to claim 1, wherein the steel consists essentially of, in weight-%, 0.08-0.12 S.

14. The steel alloy according to claim 1, wherein the steel alloy consists essentially of, in weight-%:

0.06-0.13 C, 0.1-0.4 Si, 0.2-1.3 Mn, and 0.1-0.3 V.

15. The steel alloy according to claim 14, wherein the steel alloy consists essentially of, in weight-%, 0.2-0.3 Si.

16. The steel alloy of claim 1, wherein the steel alloy has a hardness, after hardening and tempering, between 280-360 HB.

17. The steel alloy according to claim 16, wherein the total amount of C+N satisfies the condition, in weight-%, 0.18<C+N<0.25.

18. The steel alloy according to claim 16, wherein the steel alloy consists essentially of, in weight-%, 0.85-1.8 Mn.

19. The steel alloy according to claim 18, wherein the steel alloy consists essentially of, in weight-%, 0.97-0.98 Mn.

20. The steel alloy according to claim 18, wherein the steel alloy consists essentially of, in weight-%, 1.4-1.6 Mn.

21. The steel alloy according to claim 16, wherein the steel alloy consists essentially of, in weight-%, 13.5-13.7 Cr.

22. The steel alloy according to claim 16, wherein the steel alloy consists essentially of, in weight-%, at least 0.11 S.

23. The steel alloy according to claim 16, further consisting essentially of, in weight-%, at least one of max. 0.01 Ca and max. 0.01 O.

24. The steel alloy according to claim 1, wherein the steel alloy consists essentially of, in weight-%, 0.10-0.14 C.

25. The steel alloy according to claim 24, wherein the steel alloy consists essentially of, in weight-%, 0.11-0.14 C.

26. The steel alloy according to claim 1, wherein the steel alloy consists essentially of, in weight-%, 0.75-0.95 Si.

27. The steel alloy according to claim 1, further consisting essentially of, in weight-%, at least one of max. 0.01 Ca and max. 0.01 O.

28. Holders and holder details for plastic moulding tools comprising the steel alloy according to claim 1.

29. Holders and holder details for plastic moulding tools comprising the steel alloy according to claim 16.

* * * * *